US010513404B2

(12) United States Patent
Akai et al.

(10) Patent No.: US 10,513,404 B2
(45) Date of Patent: Dec. 24, 2019

(54) SHEET-MATERIAL SUPPLY DEVICE

(71) Applicant: Ricoh Company, Ltd., Ohta-ku, Tokyo (JP)

(72) Inventors: Takeshi Akai, Kanagawa (JP); Hidehiko Fujiwara, Tokyo (JP); Yasuo Niikura, Kanagawa (JP); Yousuke Edo, Kanagawa (JP); Satoru Takano, Kanagawa (JP); Yasunori Hino, Kanagawa (JP); Tadashi Matsuoka, Kanagawa (JP); Atsunori Yoshida, Kanagawa (JP); Ryo Kanno, Kanagawa (JP); Hikaru Fukasawa, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/373,522

(22) Filed: Dec. 9, 2016

(65) Prior Publication Data

US 2017/0174453 A1 Jun. 22, 2017

(30) Foreign Application Priority Data

Dec. 16, 2015 (JP) ..... 2015-245725

(51) Int. Cl.
*B65H 3/12* (2006.01)
*B65H 1/14* (2006.01)
(Continued)

(52) U.S. Cl.
CPC ..... *B65H 3/128* (2013.01); *B41J 11/0045* (2013.01); *B65H 1/14* (2013.01);
(Continued)

(58) Field of Classification Search
CPC . B65H 1/18; B65H 3/128; B65H 3/14; B65H 3/48; B65H 3/04; B65H 1/14; B65H 3/12; B65H 2406/323; B65H 7/18
See application file for complete search history.

(56) References Cited

U.S. PATENT DOCUMENTS 6,402,134 B1 * 6/2002 Gauger ..... B65H 3/0825 271/12
2008/0012208 A1 1/2008 Fujiwara et al.
(Continued)

FOREIGN PATENT DOCUMENTS

CN 101434352 A 5/2009
CN 102556701 A 7/2012
(Continued)

OTHER PUBLICATIONS

Extended European Search Report dated May 18, 2017 in Patent Application No. 16202761.9.
(Continued)

*Primary Examiner* — Luis A Gonzalez
(74) *Attorney, Agent, or Firm* — Xsensus LLP

(57) ABSTRACT

A sheet-material supply device includes a lift, a sheet-material detector, and a sheet-material retaining conveyor. The lift elevates sheet materials in a stacked state. The sheet-material detector detects that an uppermost sheet material of the sheet materials in the stacked state has reached a predetermined height. The sheet-material retaining conveyor retains and conveys the uppermost sheet material that has reached the predetermined height. The sheet-material supply device stops elevation of the sheet materials in the stacked state when the sheet-material detector detects that the uppermost sheet material has reached the predetermined height. The sheet-material retaining conveyor
(Continued)

is disposed to be movable in a direction in which the sheet materials in the stacked state elevate.

11 Claims, 22 Drawing Sheets

(51) Int. Cl.

| | |
|---|---|
| ***B65H 7/02*** | (2006.01) |
| ***B41J 11/00*** | (2006.01) |
| ***B65H 3/06*** | (2006.01) |
| ***B65H 3/14*** | (2006.01) |
| ***B65H 5/02*** | (2006.01) |

(52) U.S. Cl.

CPC ..... *B65H 3/0669* (2013.01); *B65H 3/14* (2013.01); *B65H 5/021* (2013.01); *B65H 7/02* (2013.01); *B65H 2402/10* (2013.01); *B65H 2404/2641* (2013.01); *B65H 2513/40* (2013.01); *B65H 2513/512* (2013.01); *B65H 2553/00* (2013.01)

(56) References Cited

U.S. PATENT DOCUMENTS

| | | | | |
|---|---|---|---|---|
| 2009/0257846 | A1 | 10/2009 | Matsushita et al. | |
| 2010/0225053 | A1 | 9/2010 | Nakamura et al. | |
| 2011/0272877 | A1* | 11/2011 | Wardak ..... | B65H 3/128 271/12 |
| 2012/0002252 | A1 | 1/2012 | Kubo et al. | |
| 2012/0153556 | A1 | 6/2012 | Sugiyama et al. | |
| 2012/0267846 | A1 | 10/2012 | Nakada et al. | |
| 2012/0282004 | A1 | 11/2012 | Furuhashi et al. | |
| 2013/0113154 | A1 | 5/2013 | Furuhashi et al. | |
| 2013/0134659 | A1 | 5/2013 | Konno et al. | |
| 2013/0147105 | A1 | 6/2013 | Sugiyama et al. | |
| 2013/0175755 | A1 | 7/2013 | Machida et al. | |
| 2013/0215481 | A1 | 8/2013 | Hayasaka et al. | |
| 2013/0228965 | A1 | 9/2013 | Hoshino et al. | |
| 2013/0236228 | A1 | 9/2013 | Nagasako et al. | |
| 2013/0242359 | A1 | 9/2013 | Heishi et al. | |
| 2013/0320611 | A1 | 12/2013 | Kubo et al. | |
| 2014/0011656 | A1 | 1/2014 | Niikura et al. | |
| 2014/0131938 | A1 | 5/2014 | Satoh et al. | |
| 2014/0140744 | A1 | 5/2014 | Akai et al. | |
| 2014/0145395 | A1 | 5/2014 | Takano et al. | |
| 2014/0159301 | A1 | 6/2014 | Suzuki et al. | |
| 2014/0203501 | A1 | 7/2014 | Hoshino et al. | |
| 2014/0239573 | A1 | 8/2014 | Akai et al. | |
| 2015/0045197 | A1 | 2/2015 | Sugiyama et al. | |
| 2015/0065326 | A1 | 3/2015 | Musha et al. | |
| 2015/0091246 | A1 | 4/2015 | Yoshida et al. | |
| 2015/0093214 | A1 | 4/2015 | Takahashi et al. | |
| 2015/0166280 | A1 | 6/2015 | Hino et al. | |
| 2015/0220054 | A1* | 8/2015 | Otsuka ..... | B65H 3/08 399/388 |
| 2015/0225191 | A1 | 8/2015 | Niikura et al. | |
| 2015/0253716 | A1 | 9/2015 | Nagasako et al. | |
| 2015/0360899 | A1 | 12/2015 | Takahashi et al. | |
| 2016/0016740 | A1 | 1/2016 | Niikura et al. | |
| 2016/0107853 | A1 | 4/2016 | Hashimoto et al. | |
| 2016/0107854 | A1 | 4/2016 | Hashimoto et al. | |
| 2016/0122144 | A1 | 5/2016 | Fukumoto et al. | |
| 2016/0170355 | A1 | 6/2016 | Heishi et al. | |
| 2016/0185552 | A1 | 6/2016 | Hoshino et al. | |
| 2016/0221787 | A1 | 8/2016 | Matsushita et al. | |
| 2016/0264370 | A1 | 9/2016 | Okutsu et al. | |
| 2016/0340144 | A1 | 11/2016 | Sakano et al. | |
| 2016/0340145 | A1 | 11/2016 | Kunieda et al. | |
| 2017/0060067 | A1* | 3/2017 | Nakamura ..... | G03G 15/6529 |

FOREIGN PATENT DOCUMENTS

| | | | | |
|---|---|---|---|---|
| CN | 104284853 | A | | 7/2015 |
| EP | 1 466 848 | A2 | | 10/2004 |
| GB | 2 092 117 | A | | 8/1982 |
| GB | 2 313 364 | A | | 11/1997 |
| JP | 7-084298 | | | 9/1995 |
| JP | 10-167483 | | | 6/1998 |
| JP | 2000-118840 | | | 4/2000 |
| JP | 2000-128372 | A | | 5/2000 |
| JP | 2000-198557 | A | | 7/2000 |
| JP | 2004196539 | A | * | 7/2004 |
| JP | 2004224505 | A | * | 8/2004 |
| JP | 2007099409 | A | * | 4/2007 |
| JP | 2011-006176 | A | | 1/2011 |
| JP | 2014172703 | A | * | 9/2014 |
| JP | 2014-223962 | | | 12/2014 |
| TW | 201221456 | A1 | | 6/2012 |
| TW | I455863 | B | | 10/2014 |

OTHER PUBLICATIONS

U.S. Appl. No. 15/163,850, filed May 25, 2016.

U.S. Appl. No. 15/258,342, filed Sep. 7, 2016.

U.S. Appl. No. 15/276,894, filed Sep. 27, 2016.

Combined Office Action and Search Report dated Jul. 18, 2017 in Taiwan patent application No. 105138087 (with English translation of Office Action and English translation of categories of cited documents).

Japanese Office Action dated Sep. 27, 2019, issued in corresponding Japanese Application No. 2015-245725, 2 pages.

* cited by examiner

SHEET-MATERIAL SUPPLY DEVICE

CROSS-REFERENCE TO RELATED APPLICATION

This patent application is based on and claims priority pursuant to 35 U.S.C. § 119(a) to Japanese Patent Application No. 2015-245725, filed on Dec. 16, 2015, in the Japan Patent Office, the entire disclosure of which is hereby incorporated by reference herein.

BACKGROUND

Technical Field

Aspects of the present disclosure relate to a sheet-material supply device.

Related Art

There has been conventionally known a sheet-material supply device that supplies a sheet material by attracting and retaining an uppermost sheet material of a sheet-material bundle in a stacked state that is obtained by stacking a plurality of sheet materials on a table (stacker) that can elevate, and conveying the sheet material toward an external device.

SUMMARY

In one aspect of the present disclosure, there is provided a sheet-material supply device that includes a lift, a sheet-material detector, and a sheet-material retaining conveyor. The lift elevates sheet materials in a stacked state. The sheet-material detector detects that an uppermost sheet material of the sheet materials in the stacked state has reached a predetermined height. The sheet-material retaining conveyor retains and conveys the uppermost sheet material that has reached the predetermined height. The sheet-material supply device stops elevation of the sheet materials in the stacked state when the sheet-material detector detects that the uppermost sheet material has reached the predetermined height. The sheet-material retaining conveyor is disposed to be movable in a direction in which the sheet materials in the stacked state elevate.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
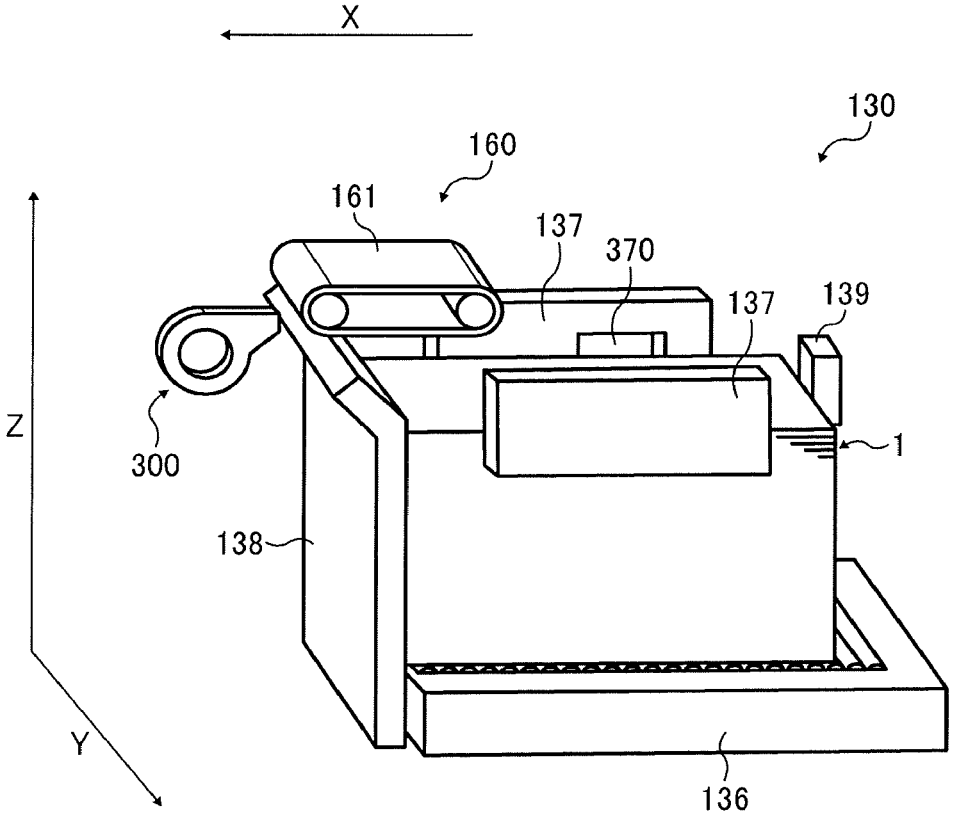
FIG. 1 is a perspective view schematically illustrating a sheet-material supply device according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Embodiments of the present disclosure will be described below referring to the drawings. In addition, a sheet-material supply device illustrated in the description of the following embodiment is not limited to that illustrated in the drawings, and various types of devices having a sorting function, an inspection function, and the like are targeted.

In addition, a supply target sheet material to be supplied by a sheet-material supply device according to the present embodiment includes a thin plate-shaped or sheet member that can be supplied by the sheet-material supply device according to the present embodiment, and can include resin, protector paper on front and rear surfaces, metallic foil such as beaten copper, electronic circuit board material having been subjected to plate processing, paper, a special film, a plastic film, an electronic circuit board sheet such as prepreg, and the like. Examples of the prepreg include plate-shaped reinforced plastic molding compound obtained by impregnating fibriform reinforcement material such as carbon fiber and glass cloth, with thermoset resin or the like that has been mixed with an additive substance such as curing agent and colorant, and semi-curing the material through heating or drying. In addition, a supply target sheet material includes a metal sheet and paper.

As an example, a sheet material having a width size of about 100 mm to 700 mm is used. In addition, a sheet material having a thickness of about 0.02 mm to 0.2 mm is used. In addition, the thickness of the sheet material is merely an example. As a matter of course, a sheet material having a thickness outside the range may be used.

In addition, in the following description, a conveyance direction X corresponds to a conveyance direction of a sheet material. A vertical direction Z corresponds to a stacking direction of the sheet material. A width direction Y corresponds to a direction perpendicular to the conveyance direction X of the sheet material and the vertical direction Z being the stacking direction of the sheet material.

Figure 2:
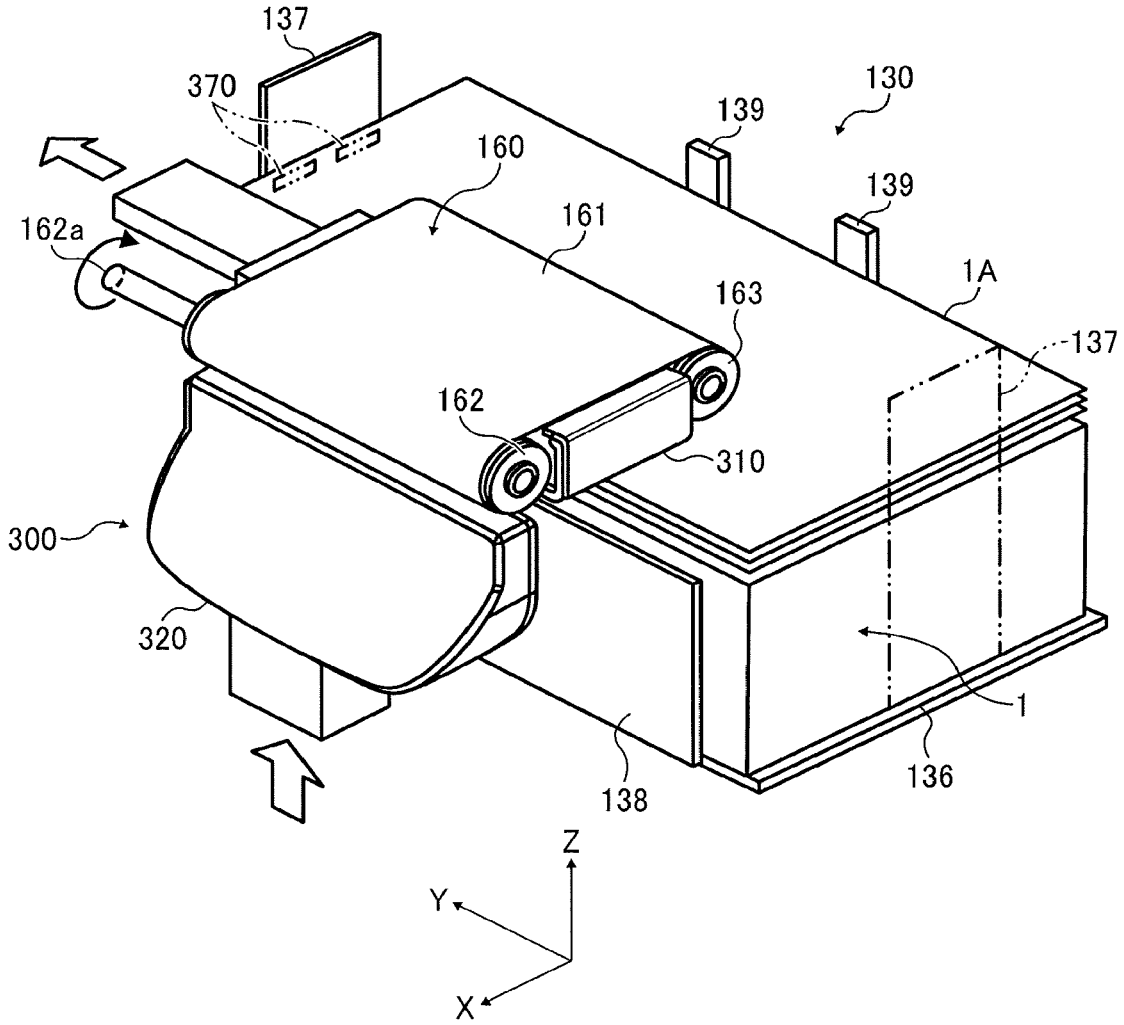
FIG. 2 is a perspective view illustrating the sheet-material supply device according to an embodiment of the present disclosure.
Figure 3:
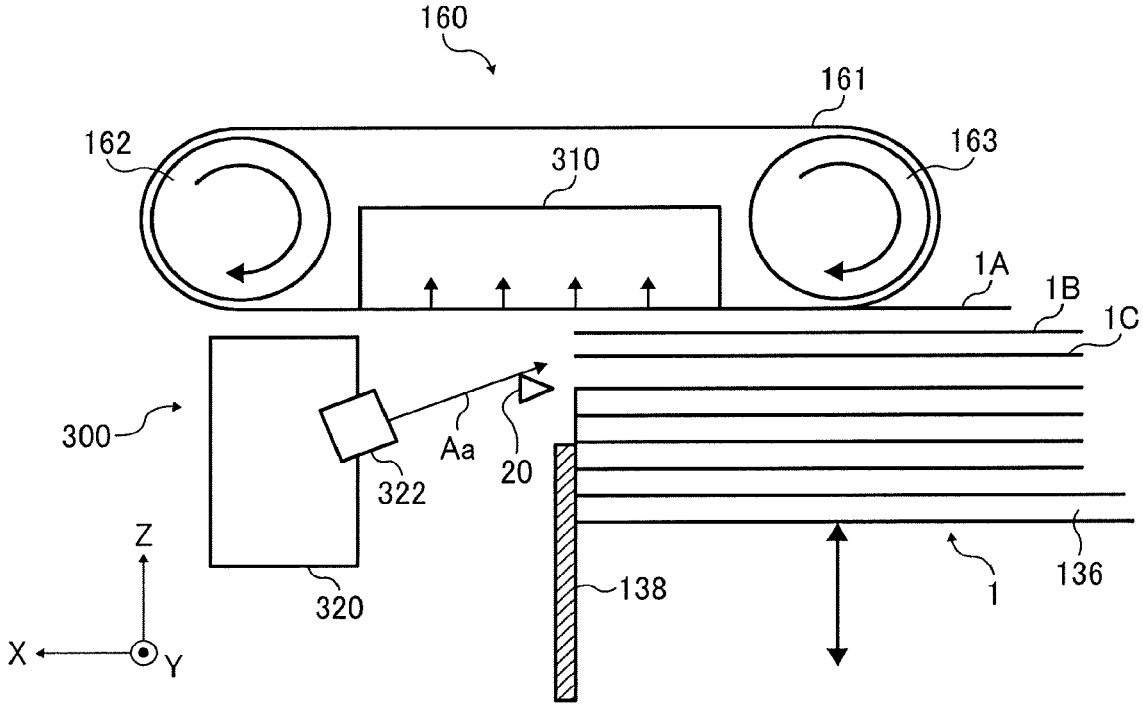
FIG. 3 is a schematic diagram illustrating a separation state of sheet materials in the sheet-material supply device according to an embodiment of the present disclosure.
Figure 4:
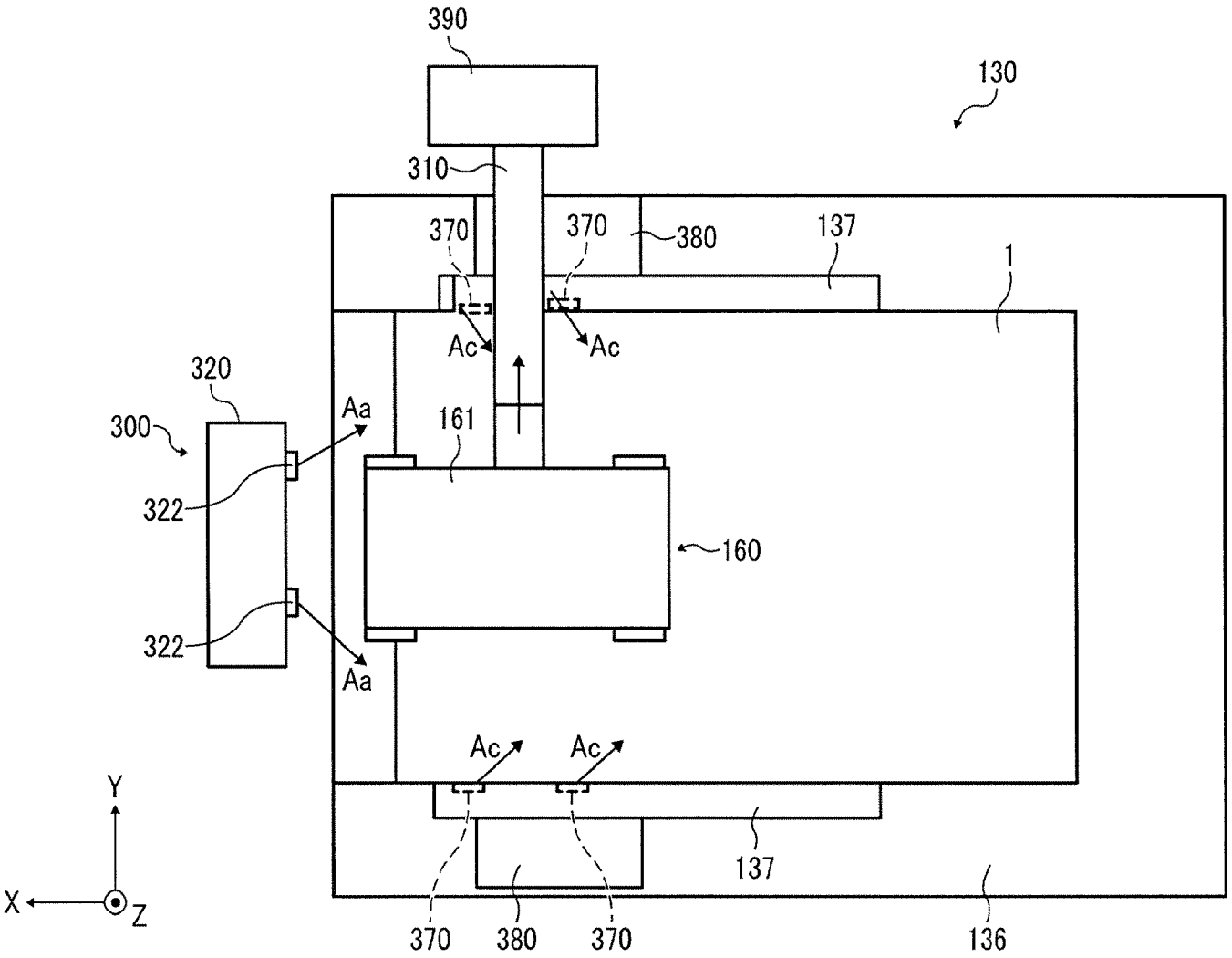
FIG. 4 is a plan view illustrating the sheet-material supply device according to an embodiment of the present disclosure.

First, a floating-and-retaining conveyance device forming the sheet-material supply device will be described using FIGS. 1 to 4. FIG. 1 is a perspective view schematically illustrating the sheet-material supply device according to the present embodiment. FIG. 2 is a perspective view illustrating the sheet-material supply device. FIG. 3 is a schematic diagram illustrating a separation state of sheet materials in the sheet-material supply device. FIG. 4 is a plan view illustrating the sheet-material supply device. In the drawings, entry and exit directions of air with respect to each device are appropriately indicated by arrows.

As illustrated in FIG. 2, a sheet-material bundle 1 is obtained by bringing a plurality of sheet materials into a stacked state. In a sheet-material supply device 130, the sheet-material bundle 1 is stacked and disposed in the stacked state on a stacking table 136 being a bottom plate.

The stacking table 136 functions as a preparation unit that prepares sheet materials in the stacked state. The stacking table 136 can move in the vertical direction Z using a lift assembly being a sheet-material-stacker driving device. In addition, the sheet-material supply device 130 includes a detection sensor 20 as a sheet-material detector that detects a top face position of the sheet-material bundle 1, and a sheet-material position controller that controls the top face position of the sheet-material bundle 1 by controlling the drive of the lift assembly. With this configuration, if the top face of the sheet-material bundle 1 on the stacking table 136 reaches a predetermined height position detected by the detection sensor 20, an uppermost sheet material 1A is separated and conveyed through an operation described later.

The sheet-material supply device 130 is provided with side fences 137 and 137 being a pair of sheet-material position regulators, a front end guide plate 138, and an end fence 139. The side fences 137 and 137 are disposed on the lateral sides in the sheet material width direction Y of the stacking table 136, to perform positioning in the sheet material width direction Y intersecting with (perpendicular to) the conveyance direction X of the disposed sheet-material bundle 1. The front end guide plate 138 performs positioning of a front end in a length direction corresponding to the conveyance direction X of the sheet-material bundle 1. Furthermore, the end fence 139 similarly performs positioning of a rear end in the length direction.

A side air nozzle 370 indicated by a broken line that is provided on one (left rear side in FIG. 2) of the side fences 137 and 137 in FIG. 2 functions as a second air ejection member as a distribution blower and an air ejector that ejects and blows side air Ac (refer to FIG. 4) onto a lateral end of the sheet-material bundle 1. As illustrated in FIG. 4, the side air nozzle 370 is connected to a side blower 380 functioning as a side air generator that generates the side air Ac.

The sheet-material supply device 130 in FIG. 2 and a floating-and-retaining conveyance device 160 in FIG. 3 include a drive roller 162, a driven roller 163, a conveyance belt 161, and a negative pressure air chamber 310. The drive roller 162 is driven to rotate around a drive shaft 162*a*, and the driven roller 163 rotates in conjunction with the conveyance belt 161 rolling according to the drive of the drive roller 162. The conveyance belt 161 is an endless belt member provided with a number of suction holes communicated with the negative pressure air chamber 310. The negative pressure air chamber 310 is connected to a suction blower 390 illustrated in FIG. 4, and keeps a negative pressure state by being sucked from the outside suction blower 390, to suck and attract the uppermost sheet material 1A using the suction holes of the conveyance belt 161. The suction blower 390 functions as a suction air generator that generates suction air.

As described above, the conveyance belt 161 of the floating-and-retaining conveyance device 160 functions as a retaining member that retains and separates a floated sheet material by attracting the sheet material using the negative pressure caused by air suction, and a conveyor that conveys the retained sheet material.

The floating-and-retaining conveyance device 160 may increase the size of the floating-and-retaining conveyance device 160 according to the size of the sheet material. In addition, a plurality of the floating-and-retaining conveyance devices 160 may be used. In addition, conveyance may be started after the completion of retainment and separation of the sheet material that are performed by the floating-and-retaining conveyance device 160, or conveyance may be started before the completion of the retainment and separation. Here, the "retainment" refers to a state in which at least a part of the floated sheet material is retained by the floating-and-retaining conveyance device 160.

An air ejection nozzle device 300 that also serves as an air blower is disposed at a position opposing the front end of the stacked sheet-material bundle 1. In the air ejection nozzle device 300, an air chamber 320 is disposed. From the outside, air being pressurized gas (hereinafter, also referred to as air) is sent to the air chamber 320, and stored therein. In addition, as illustrated in FIGS. 3 and 4, the air chamber 320 is provided with 2 floating nozzles 322.

As described above, the air ejection nozzle device 300 functions as a floating unit that floats a sheet material stacked and prepared on the stacking table 136. Furthermore, the air ejection nozzle device 300 functions as an air ejector that ejects air onto the stacked sheet material and floats the sheet material, and a first air ejection member that ejects air in a direction opposite to the conveyance direction X.

In addition, an air ejecting direction is only required to be a direction opposite to the conveyance direction X. Thus, the air ejecting direction does not have to be parallel to the conveyance direction X, and may be an oblique direction. In addition, the air being gas includes electrically-discharged air, gas used for floating other sheet materials, and separating the sheet materials one by one, and the like. It is especially effective for sheet materials containing carbon fiber to blow electrically-discharged air onto the sheet-material bundle 1 in the stacked state because the sheet materials in the stacked state adhere each other by an electrostatic action, and are difficult to be separated.

As illustrated in FIGS. 3 and 4, the floating nozzles 322 blow floating air Aa toward an end on the front side (hereinafter, also referred to as a front end) of the sheet-material bundle 1, and float a sheet material from the sheet-material bundle 1. In addition, for example, an assembly for shifting the sheets may be further provided, and the floating nozzles 322 may float an end of the sheet material by blowing air onto a position of the sheet-material bundle 1 that is closer to the center than the front end. In addition, if blown air is hot air, an effect of dehumidifying the sheet materials is added, so that separation and distribution can be performed more effectively.

Figure 5:
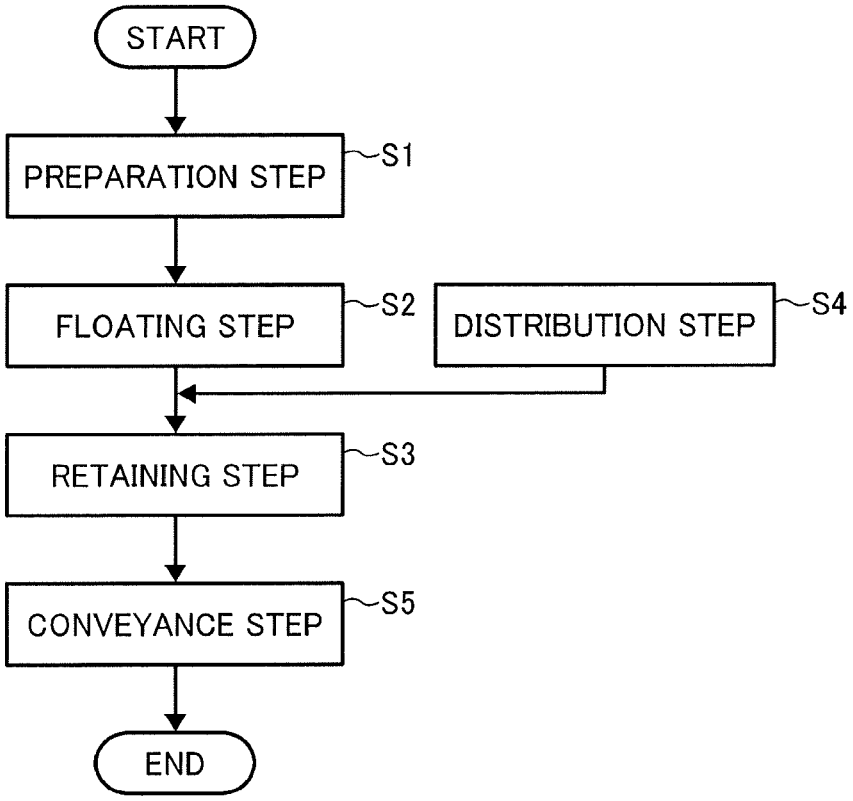
FIG. 5 is a diagram illustrating main steps executed by the sheet-material supply device according to the present embodiment.
Figure 6A:
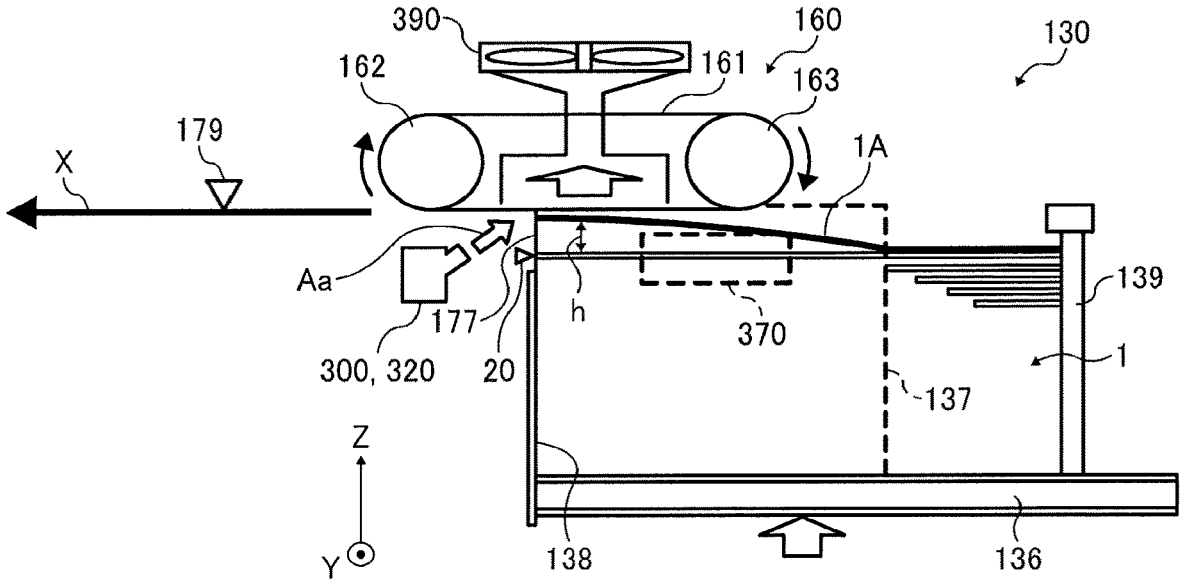
FIGS. 6A, 6B, and 6C are diagrams each illustrating an operation transition state of the sheet-material supply device according to the present embodiment.
Figure 6B:
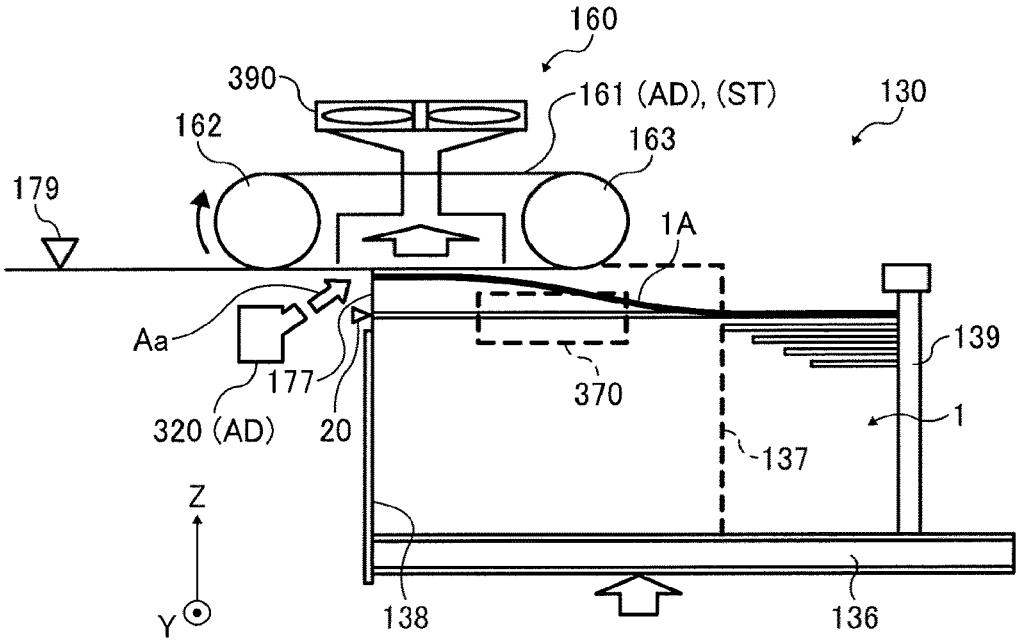
Figure 6C:
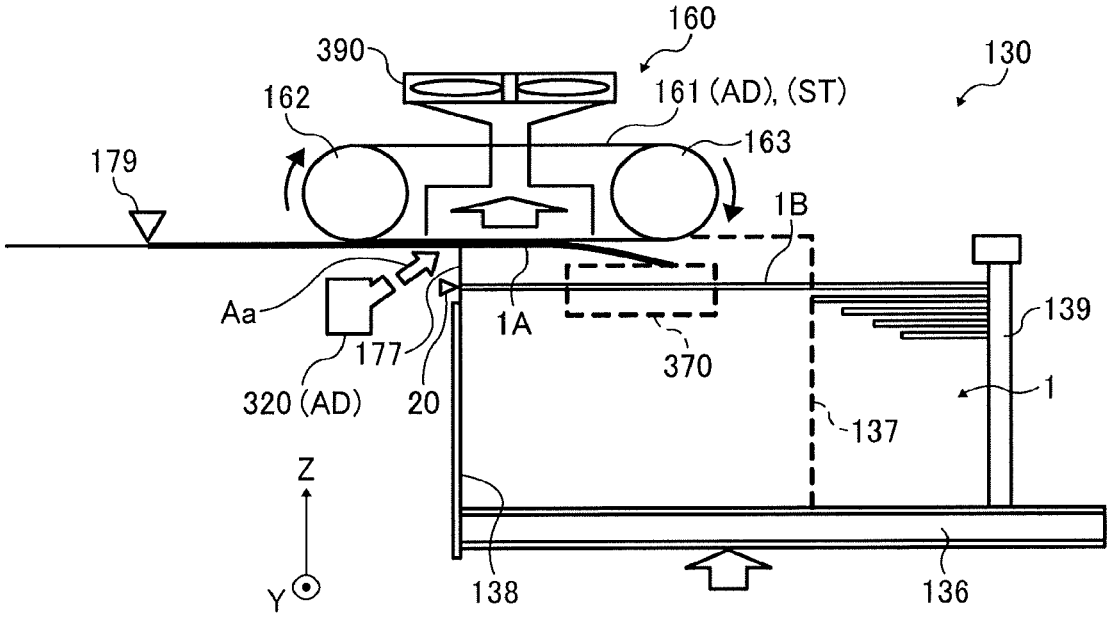
Figure 7A:
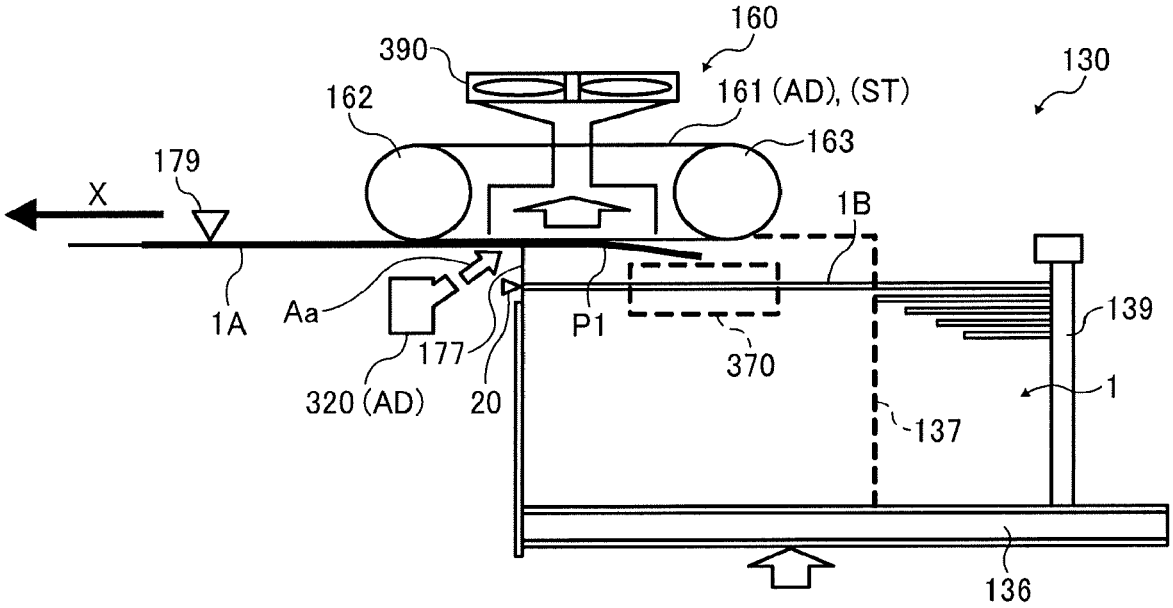
FIGS. 7A and 7B are diagrams each illustrating an operation transition state of the sheet-material supply device following FIG. 6C, according to an embodiment of the present disclosure.
Figure 7B:
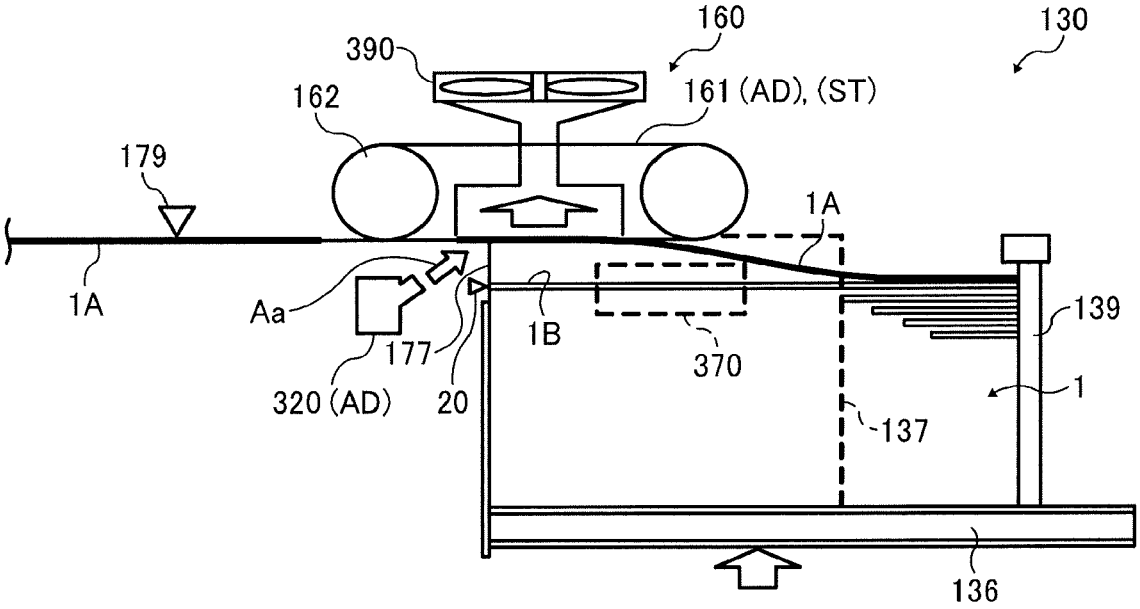

FIG. 5 is a diagram illustrating main steps executed by the sheet-material supply device according to the present embodiment. FIGS. 6A, 6B, and 6C are diagrams each illustrating an operation transition state of the sheet-material supply device according to the present embodiment. FIGS. 7A and 7B are diagrams each illustrating an operation transition state of the sheet-material supply device following FIG. 6C. First, the configuration and the operation of the above-described sheet-material supply device 130 will be supplementarily described using FIG. 6A. The sheet-material supply device 130 illustrated in FIG. 6A blows the floating air Aa from the air chamber 320 toward a front-end face of the sheet-material bundle 1 stacked on the stacking table 136, and using the air, floats a sheet material to the height of the conveyance belt 161 (sheet-material retainer).

Then, by the operation of the suction blower 390, one sheet material on the uppermost face of the sheet-material bundle 1 is retained by the conveyance belt 161. The uppermost sheet material 1A retained by the conveyance belt 161 is not always a single sheet material. In some cases, sheet materials may be retained in the state of adhering each other. Thus, the side air nozzles 370 as a distribution blower that are provided on the side fences 137 and 137 blow side air, and distribute the sheet materials 1A retained by the conveyance belt 161 so as to be a single sheet material. The distribution refers to assisting the separation by decreasing the adhesion between the sheet materials by ejecting air from side air. After that, the sheet material 1A is conveyed by the conveyance belt 161 to a target conveyance destination (for example, next step). Then, necessary processing is performed.

A sheet-material stopper 177 is disposed between the air chamber 320 and the sheet-material bundle 1 stacked on the uppermost part, and the sheet-material stopper 177 prevents sheet materials other than the uppermost sheet material 1A from being conveyed. In addition, the detection sensor 20 that detects the height of the sheet material is provided for always keeping a distance h constant. The distance h is a distance between the uppermost face position of the sheet materials that declines according to fed sheet materials, and the conveyance belt 161. The detection sensor 20 is a reflective photosensor. The stacking table 136 is adjusted by being elevated using a sheet-material-stacker driving device (lift assembly), based on a signal of the detection sensor 20.

On the stacking table 136, the sheet-material bundle 1 is aligned in accordance with a sheet material size, using the front-end face as a reference face. In addition, a sheet feeding sensor 179 that detects that the sheet material has reached is provided on a downstream in the conveyance direction X of the floating-and-retaining conveyance device 160.

Next, the operations and steps of the sheet-material supply device 130 will be sequentially described. (1) A preparation step (step S1) of preparing sheet materials in the stacked state is performed in the following manner, for example. Specifically, the sheet-material bundle 1 is stacked by an operator on the stacking table 136. Then, for setting the sheet-material bundle 1 in accordance with the sheet material size, the front-end face of the sheet-material bundle 1 is brought into contact with the front end guide plate 138, to be aligned as the reference face. In addition, by operating the side fences 137 and 137 and the end fence 139, lateral end faces and a rear end face of the sheet-material bundle 1 are aligned. In addition, in the preparation step, in place of manpower of the operator or the like, for example, a robot or a dedicated device may perform a stacking operation and sheet material size alignment of the sheet-material bundle 1 as described above.

If a sheet material feeding command is issued from a control unit of the sheet-material supply device 130 in FIG. 1, as illustrated in FIG. 6B, a distribution blower including the air chamber 320 of the air ejection nozzle device 300 and the side air nozzle 370 operates. Then, a floating step as a first step of blowing air onto each end of the sheet materials is started (step S2 in FIG. 5). By the floating air Aa being blown from the floating nozzles 322 of the air chamber 320, and the side air Ac being blown from the side air nozzle 370, uppermost sheet materials 1A, 1B, and 1C prepared on the stacking table 136 are floated. This changes a contact area of the uppermost sheet materials 1A, 1B, and 1C.

At the same time, a retaining step (step S3 in FIG. 5) as a second step of retaining the floating sheet material is started, and air suction performed by the conveyance belt 161 is started. As a result, the uppermost sheet material 1A floats, and the uppermost sheet material 1A is attracted and retained by the conveyance belt 161 as illustrated in FIG. 6B.

In addition, in FIG. 6B, "(AD)" in parentheses added to the sign of the air chamber 320 or the conveyance belt 161 indicates a blowing drive state of the air chamber 320 or a suction drive state of the conveyance belt 161. In addition, "(ST)" in parentheses added to the sign of the conveyance belt 161 indicates that the conveyance belt 161 is in a stopped state.

A "distribution step" in step S4 in FIG. 5 is a step of distributing sheet materials retained by the conveyance belt 161, and is performed by the distribution blower including the side air nozzle 370, as described above. (2) Subsequently, as illustrated in FIG. 6C, the drive of the conveyance belt 161 is started, and a conveyance step of conveying the sheet material 1A retained by the conveyance belt 161 is performed (step S5 in FIG. 5). In addition, in FIG. 6C, "(AD)" in parentheses added to the sign of the conveyance belt 161 indicates that the conveyance belt 161 is in a rotational conveyance drive state.

(3) Subsequently, as illustrated in FIG. 7A, after a circuit board sheet 1A goes out of the conveyance belt 161 after a predetermined time elapses since the sheet material 1A reaches the sheet feeding sensor 179, the rotational conveyance drive is stopped. (4) Immediately after the sheet material 1A goes out of a retaining area of the conveyance belt 161, as illustrated in FIG. 7B, a next sheet material 1A is floated by air blowing, and retained by the conveyance belt 161. (5) The drive of the conveyance belt 161 is restarted according to a set sheet material feeding interval, and the sheet material 1A is fed. (6) Thereafter, sheet materials are sequentially conveyed by repeating the above-described steps illustrated in FIGS. 6B to 7B.

In the above-described sheet-material feeding operation, an air amount of air from the air chamber 320, the distribution blower, and the suction blower 390 is not described. If an air amount of air is fixed to a certain value, a floating amount and a distribution state of sheet materials vary depending on the thickness, the weight, and the size of the stacked sheet materials.

For example, if a floating amount of a sheet material is small, the sheet material is not supplied (not fed). In contrast, if sheet materials are in the state of floating too much, the sheet materials adhere to each other, leading to multi-feed. In addition, if the power of the suction blower 390 is small, sheet materials cannot be successfully conveyed. Also in this case, the sheet materials are not supplied, either.

Thus, for appropriately performing sheet material feeding, an air amount suitable for a stacked sheet material is predetermined, and if a user or an operator selects a sheet material desired to be fed, an air amount is automatically set to the predetermined air amount. In addition, an air amount is adjusted according to the value of a duty of a blower.

In addition, a circuit board manufactured using a damaged sheet material may cause a failure in an electrical property (resistance value). Thus, there is such an issue that the separation of sheet materials must be performed so as not to cause a failure in an electrical property (resistance value) of a separated sheet material. To solve the issue, a sheet material separation method of the sheet-material supply device 130 according to the present embodiment includes the following steps: the preparation step including step S1, the first step (floating step) including step S2, and the second step (retaining step) including step S3. In the preparation step including step S1, sheet materials such as the sheet-material bundle 1 are prepared in the stacked state. In the first step (floating step) including step S2, the stacked sheet materials are floated by ejecting air from an air ejector and an air ejection member including the air ejection nozzle device 300. In the second step (retaining step) including step S3, the floated sheet materials are retained by a retaining member including the conveyance belt 161, and separated. By executing such steps, the sheet materials can be easily separated without impairing the quality of the sheet materials (without damaging the sheet materials).

In the sheet-material supply device 130 according to the above-described embodiment, in some cases, a small-sized foreign substance or sheet material smaller than a large-sized (large-format) supply target sheet material may be placed at a position opposing a sheet attraction position of the floating-and-retaining conveyance device on the uppermost face of the sheet-material bundle 1 in the stacked state. If the stacking table 136 on which sheet materials are stacked is elevated in this case, the small-sized sheet material or foreign substance contacts a lower end of the floating-and-retaining conveyance device before the detection sensor 20 as a sheet-material detector detects that the sheet material 1A is positioned at the predetermined height. If the floating-and-retaining conveyance device continues elevating in such a contact state, the floating-and-retaining conveyance device may be damaged, or the small-sized sheet material or foreign substance placed on the uppermost face of the sheet-material bundle 1 may be damaged.

Thus, in the following embodiment, a plurality of floating-and-retaining conveyance devices (sheet-material retaining conveyors) that retains and conveys the sheet material 1A is disposed to be movable in a direction in which the sheet-material bundle 1 in the stacked state that is stacked on the stacking table 136 elevates. In addition, the elevating drive of the stacking table 136 is controlled to stop when the elevation of at least one of the plurality of floating-and-retaining conveyance devices is detected in the elevating drive of the stacking table 136.

Figure 8:
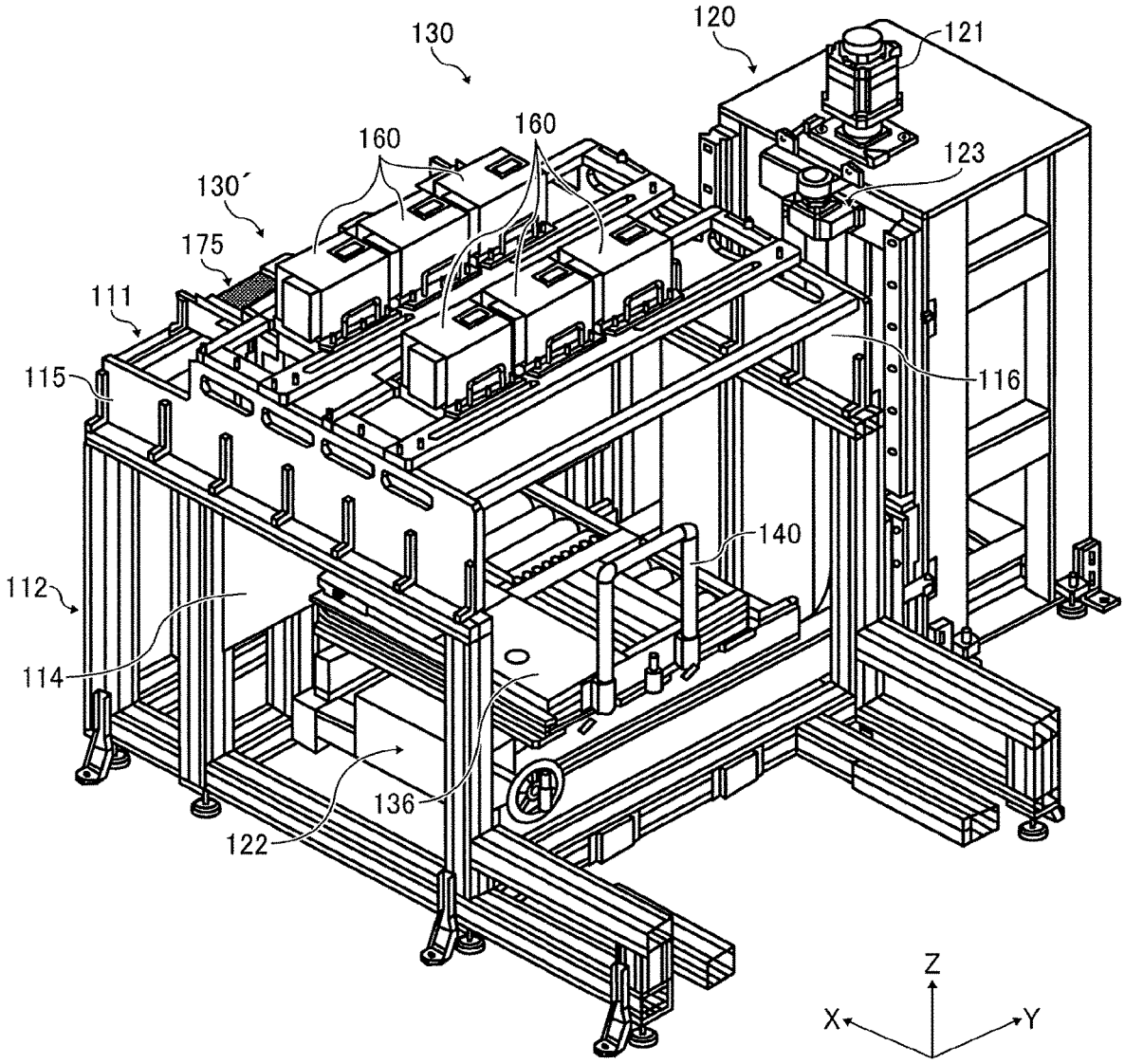
FIG. 8 is a perspective view illustrating an example of a more detailed general arrangement of the sheet-material supply device according to the present embodiment of the present disclosure.
Figure 9:
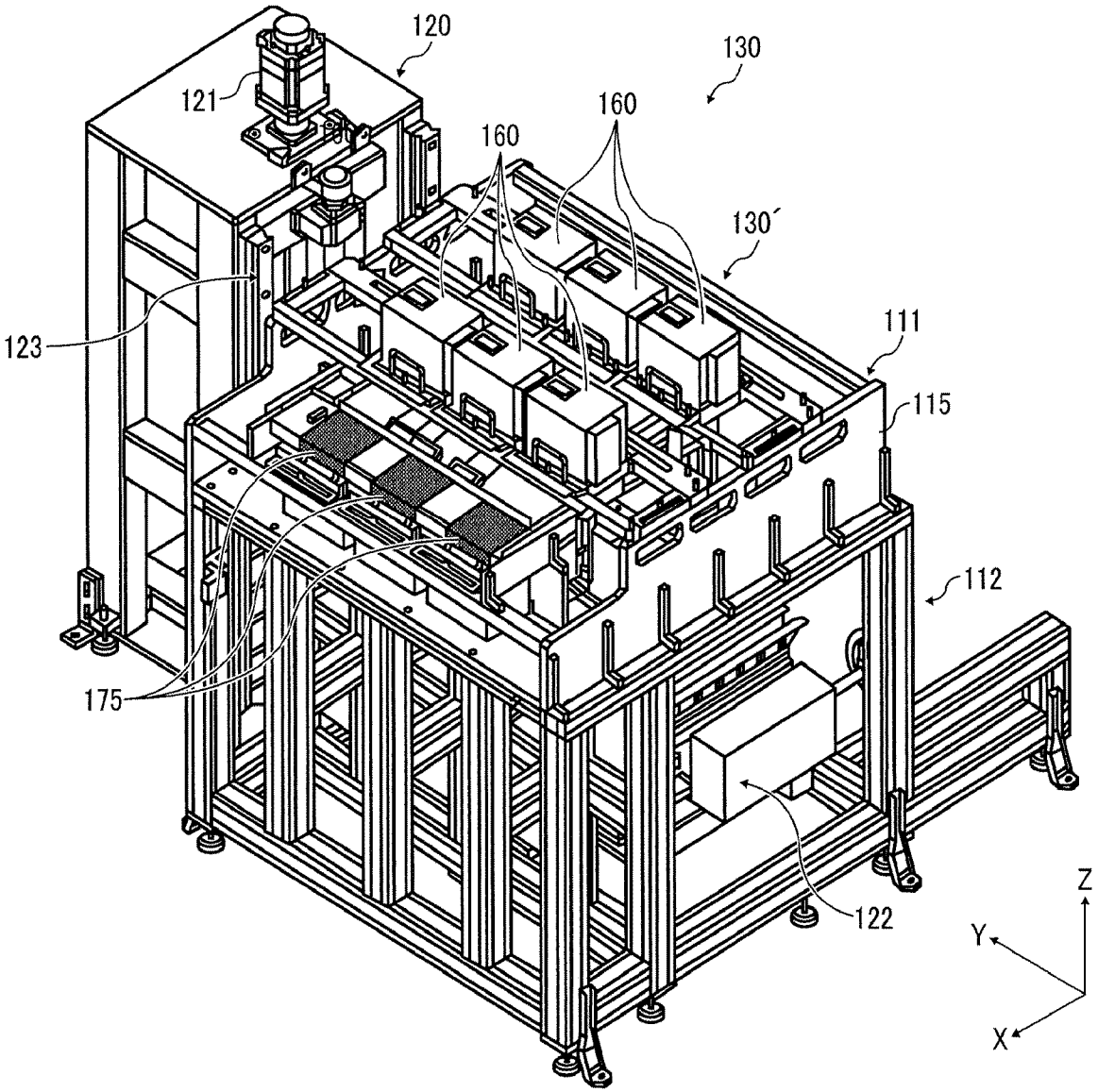
FIG. 9 is a perspective view of the sheet-material supply device according to an embodiment of the present disclosure, viewed from a different angle.
Figure 10:
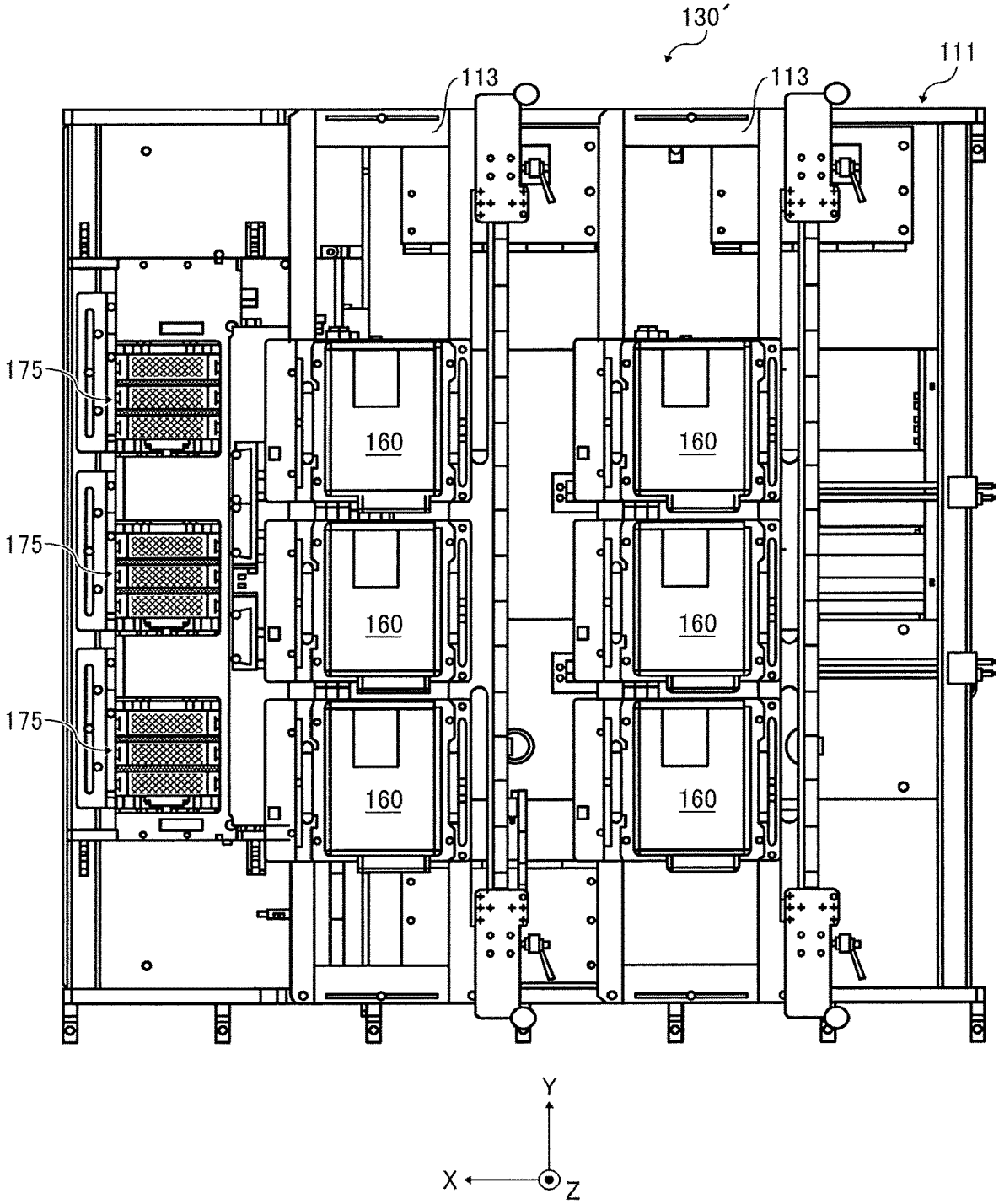
FIG. 10 is a plan view of a part of a body of the sheet-material supply device according to an embodiment of the present disclosure.
Figure 11:
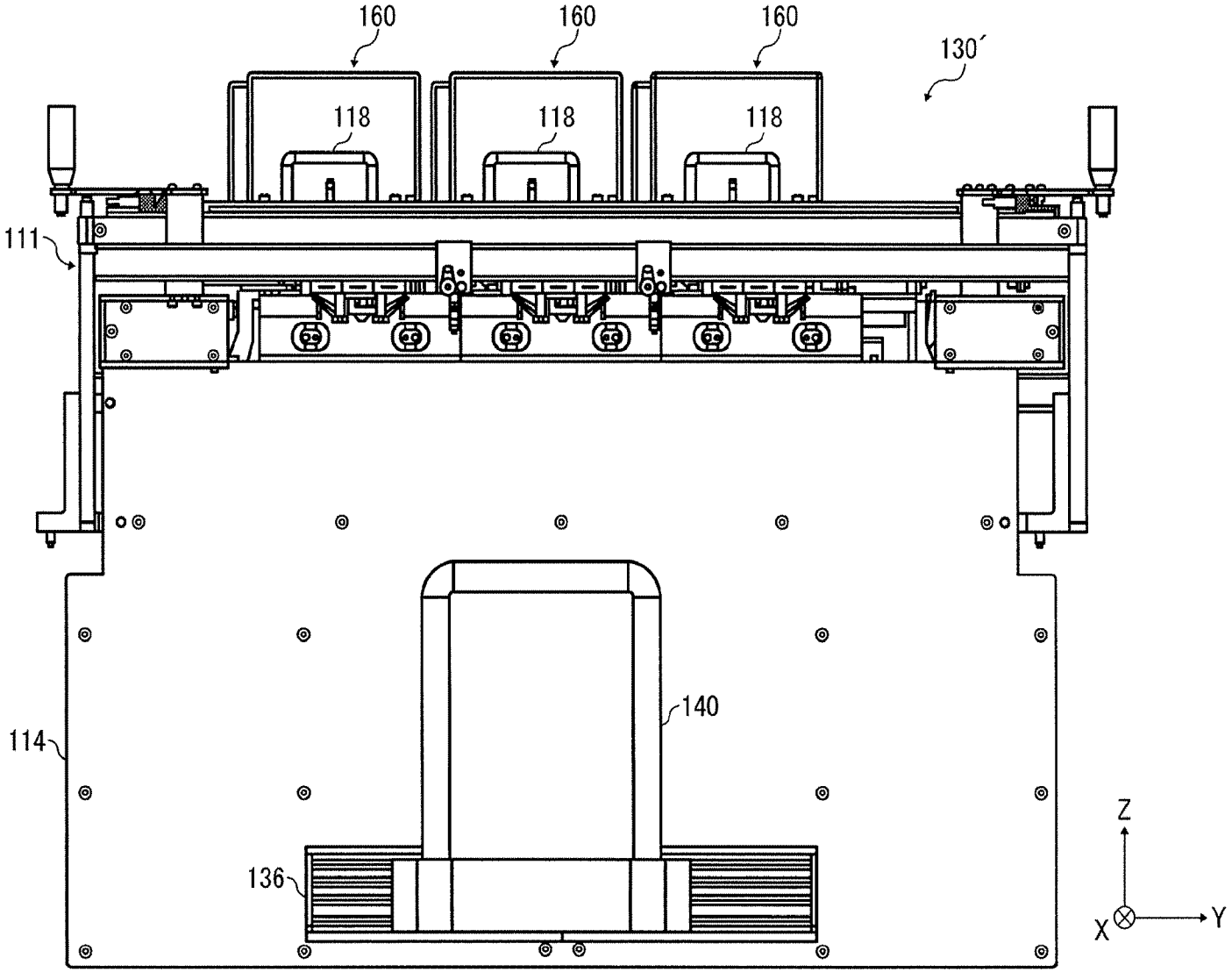
FIG. 11 is a front view of a part of the body of the sheet-material supply device according to an embodiment of the present disclosure.
Figure 12:
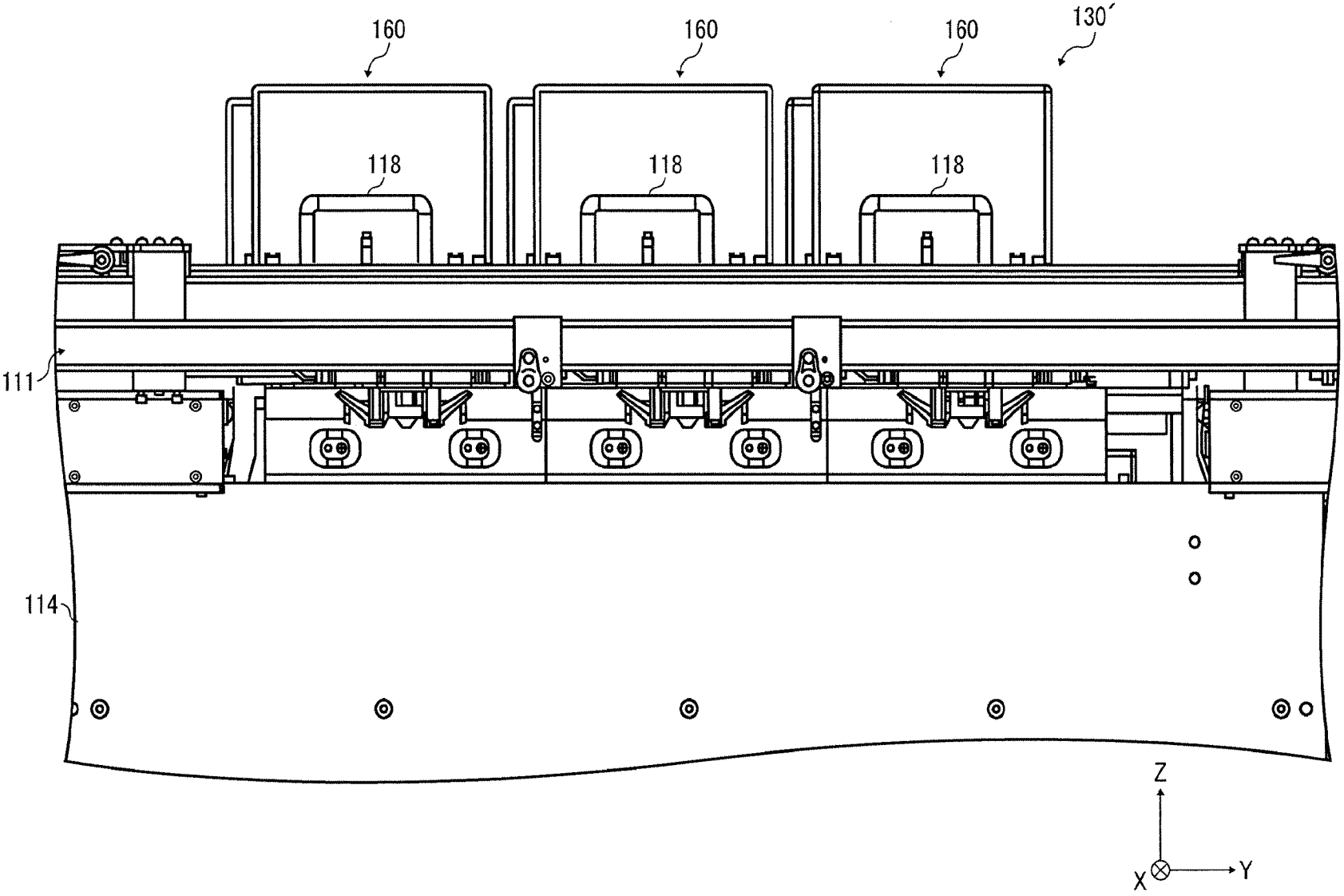
FIG. 12 is an enlarged front view of a part of the body of the sheet-material supply device according to an embodiment of the present disclosure.
Figure 13A:
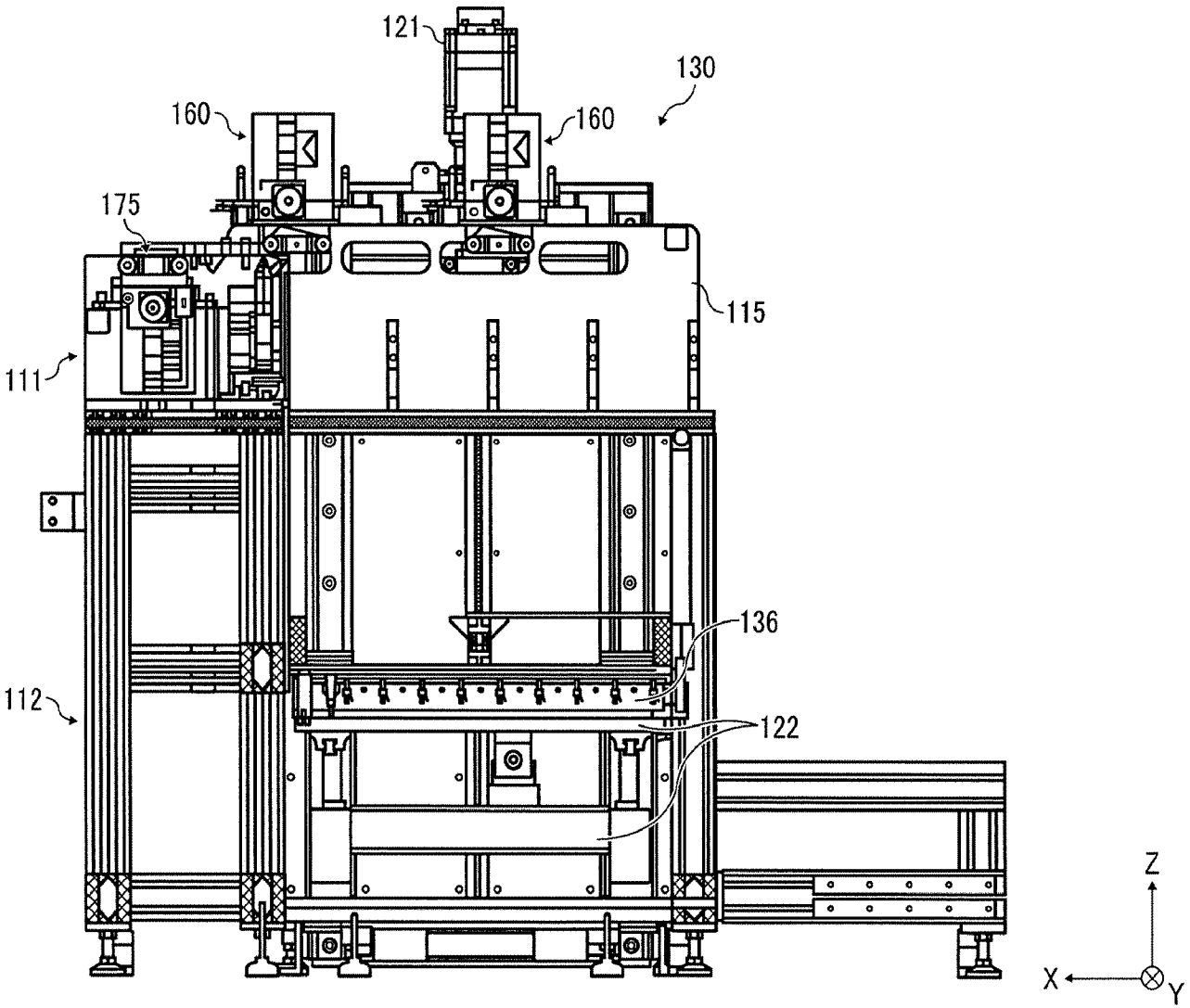
FIGS. 13A and 13B are front views each illustrating a state of elevation of a stacking table of the sheet-material supply device according to an embodiment of the present disclosure.
Figure 13B:
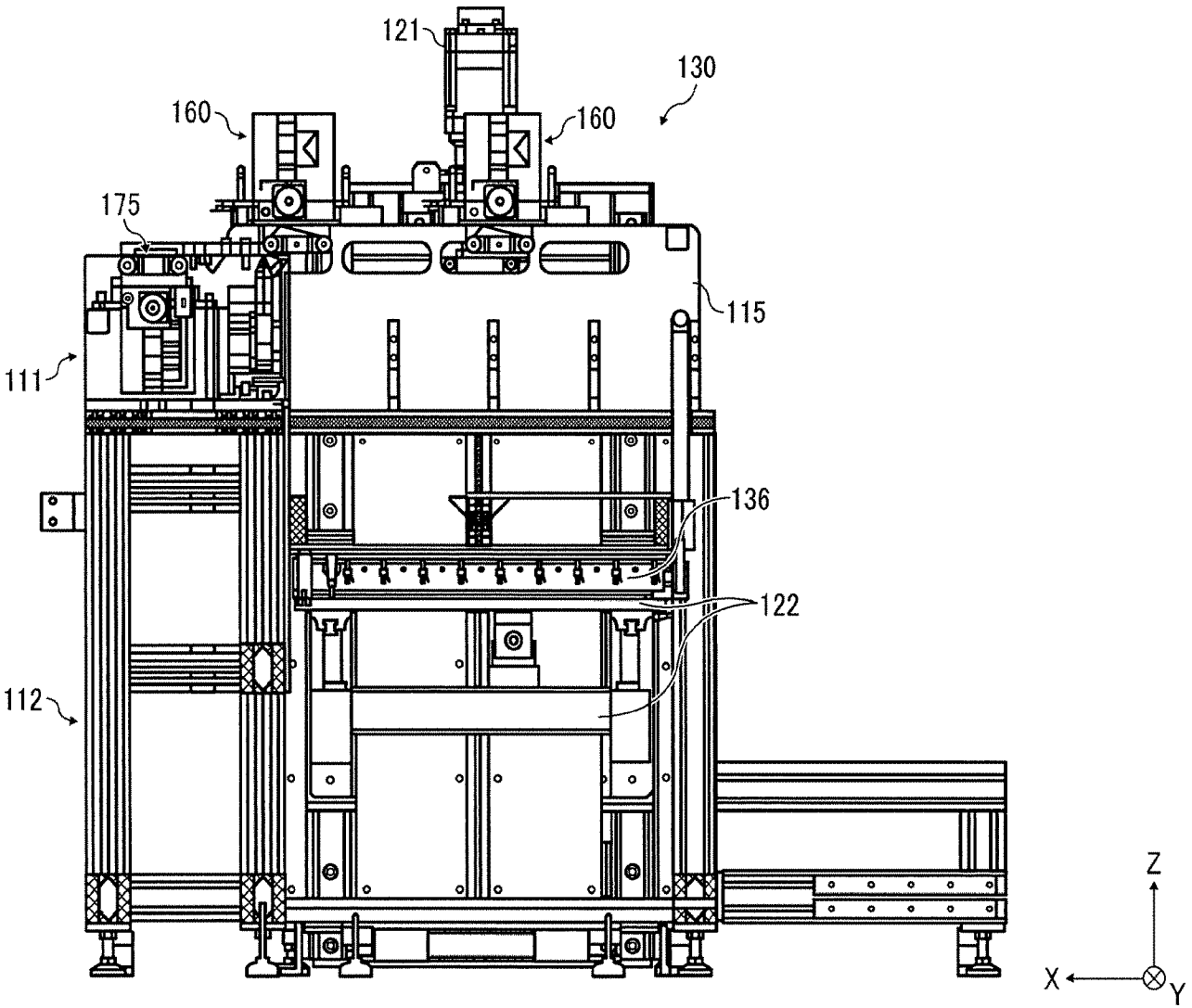

FIG. 8 is a perspective view illustrating an example of a more detailed general arrangement of a sheet-material supply device 130 according to the present embodiment. FIG. 9 is a perspective view of the sheet-material supply device 130 viewed from a different angle. In addition, FIGS. 10 and 11 are a plan view and a front view of a part of a main body 130' of the sheet-material supply device 130. FIG. 12 is an enlarged front view of a part of the main body 130' of the sheet-material supply device 130. In addition, FIGS. 13A and 13B are front views each illustrating a state of elevation of the stacking table of the sheet-material supply device. In addition, in the following description, components (members and components) and the like that have functions, shapes, and the like that are similar or common to the above-described ones illustrated in FIGS. 1 to 7B are assigned the same signs, and the descriptions thereof will be omitted.

The sheet-material supply device 130 according to the present embodiment includes a plurality of (6 in the example illustrated in the drawings) floating-and-retaining conveyance devices 160 similar to that in the above-described sheet-material supply device illustrated in FIGS. 1 to 7B, so as to be able to supply large-sized (large-format) sheet materials. The sheet-material supply device 130 includes the main body 130' and a lift device 120 as an elevator. The main body 130' has an upper frame 111 and a lower frame 112. On the upper frame 111, 3 floating-and-retaining conveyance devices 160 are arranged in each of 2 columns, i.e., 6 floating-and-retaining conveyance devices 160 in total are disposed. The upper frame 111 has a back face side plate 114, and left and right side plates 115 and 116.

On the side of the plurality of floating-and-retaining conveyance devices 160 in an X direction in the drawings, there is included a plurality of (3 in the example illustrated in the drawings) conveyance belt units 175 as a sheet-material conveyor to further convey sheet materials retained and conveyed by the floating-and-retaining conveyance devices 160, toward an external device. The conveyance belt units 175 can be formed by, for example, units obtained by vertically inverting the above-described floating-and-retaining conveyance device 160 described using FIGS. 1 to 7B.

The lift device 120 includes a drive motor 121 as a drive source, a lift support table 122 inserted into the lower frame 112 of the main body 130' so as to be vertically movable, and a drive transmitter 123 that drives the lift support table 122 in the vertical direction by transmitting rotational drive force of the drive motor 121. The drive transmitter 123 can be formed by, for example, a gear, a driving belt, and the like.

A stacking table 136 on which sheet materials are to be stacked is installed on the lift support table 122 that is moved in the vertical direction by the lift device 120. The stacking table 136 is provided with a handle 140. By operating the handle 140, a user (operator) can move the stacking table 136 onto the lift support table 122 lowered to a predetermined stacking table attachment position in FIG. 13A, and install the stacking table 136 thereon. After the stacking table 136 is installed, by controlling the drive motor 121 of the lift device 120 to be turned on, the lift support table 122 and the stacking table 136 can be elevated as illustrated in FIG. 13B, from the lowered position in FIG. 13A.

In addition, as illustrated in FIGS. 11 and 12, each of the plurality of floating-and-retaining conveyance devices 160 is provided with a handle 118. By operating the handle 118, the user (operator) can individually attach and detach each of the floating-and-retaining conveyance devices 160 to and from the main body 130'.

Figure 14:
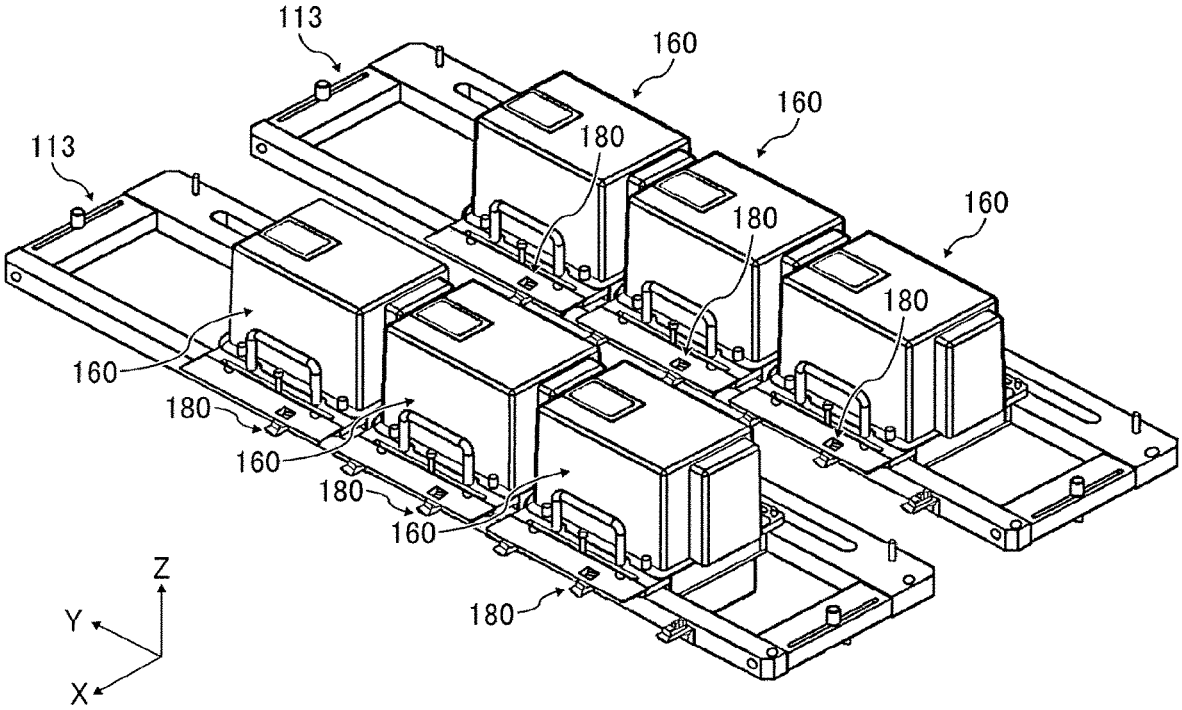
FIG. 14 is a perspective view of a plurality of floating-and-retaining conveyance devices and supports thereof that form the sheet-material supply device according to an embodiment of the present disclosure.
Figure 15:
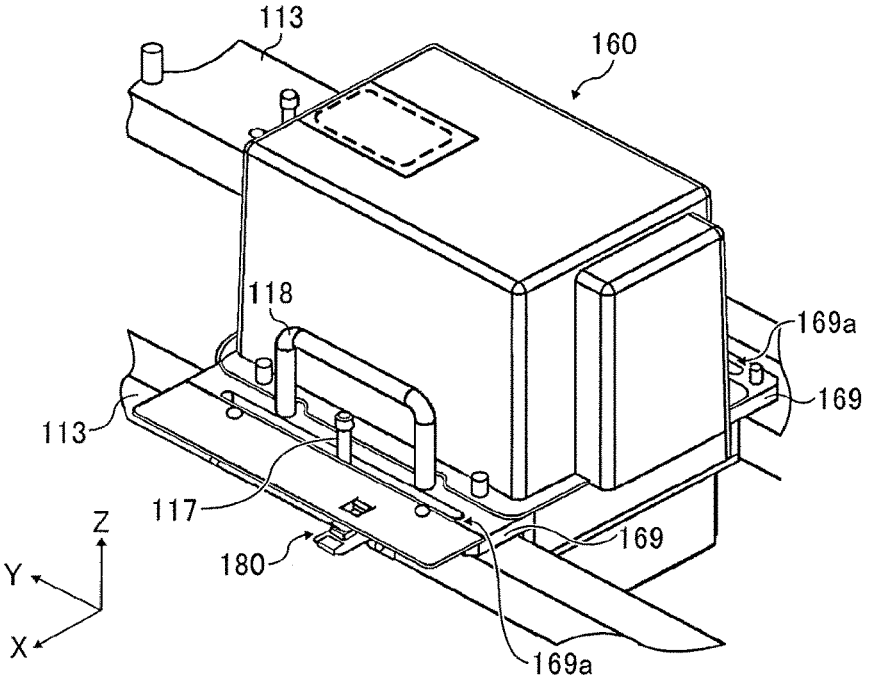
FIG. 15 is an enlarged perspective view of the floating-and-retaining conveyance device according to an embodiment of the present disclosure.

FIG. 14 is a perspective view of the plurality of floating-and-retaining conveyance devices 160 and supports thereof that form the sheet-material supply device 130 according to the present embodiment. FIG. 15 is an enlarged perspective view of the floating-and-retaining conveyance device 160. The floating-and-retaining conveyance devices 160 are arranged and installed on a support frame 113 with three devices in one column as one unit, in the state of being movable in an upward direction (Z direction) in the drawings, that is, in a direction in which a sheet-material bundle 1 stacked on the stacking table 136 elevates. In the example illustrated in the drawings, guide holes 169*a* formed by slit-shaped through-holes extending in a Y direction are formed on flanges 169 provided at both ends in the X direction of the floating-and-retaining conveyance device 160. By causing support guide pins 117 provided on the support frame 113 side, to penetrate through the guide holes 169*a*, the floating-and-retaining conveyance device 160 can be attached onto the support frame 113 in the state of being movable upward. In addition, on the side of one of the flanges 169 of the floating-and-retaining conveyance device 160, an elevation detector 180 that detects the elevation of the floating-and-retaining conveyance device 160 is provided. The elevation detector 180 also serves as an attachment and detachment detector that detects the attachment and detachment of the floating-and-retaining conveyance device 160.

Figure 16A:
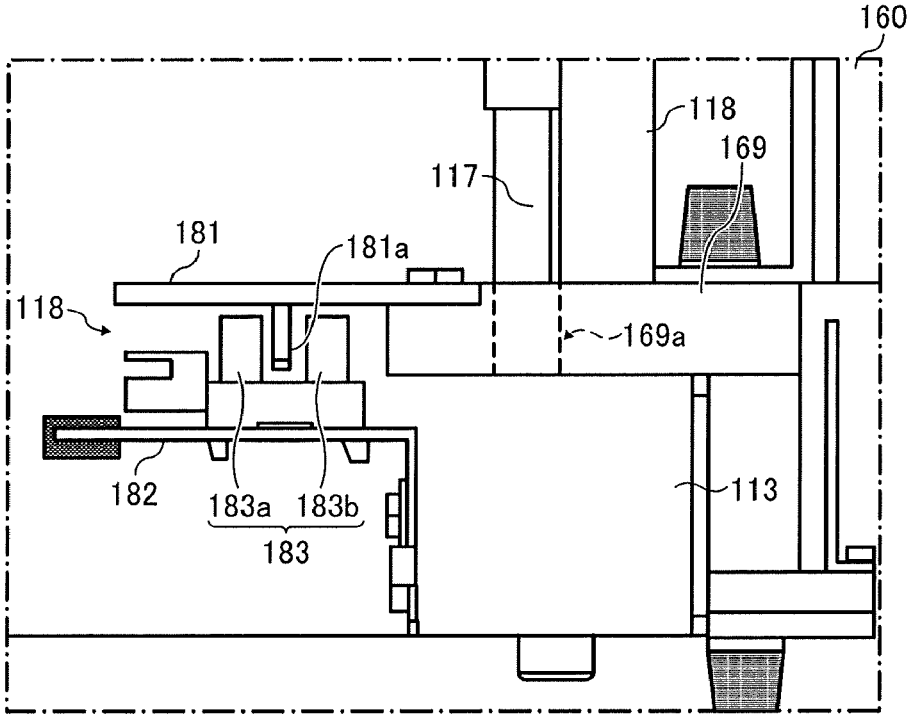
FIG. 16A is an illustration illustrating a configuration example of an elevation detector of the floating-and-retaining conveyance device according to an embodiment of the present disclosure.
Figure 16B:
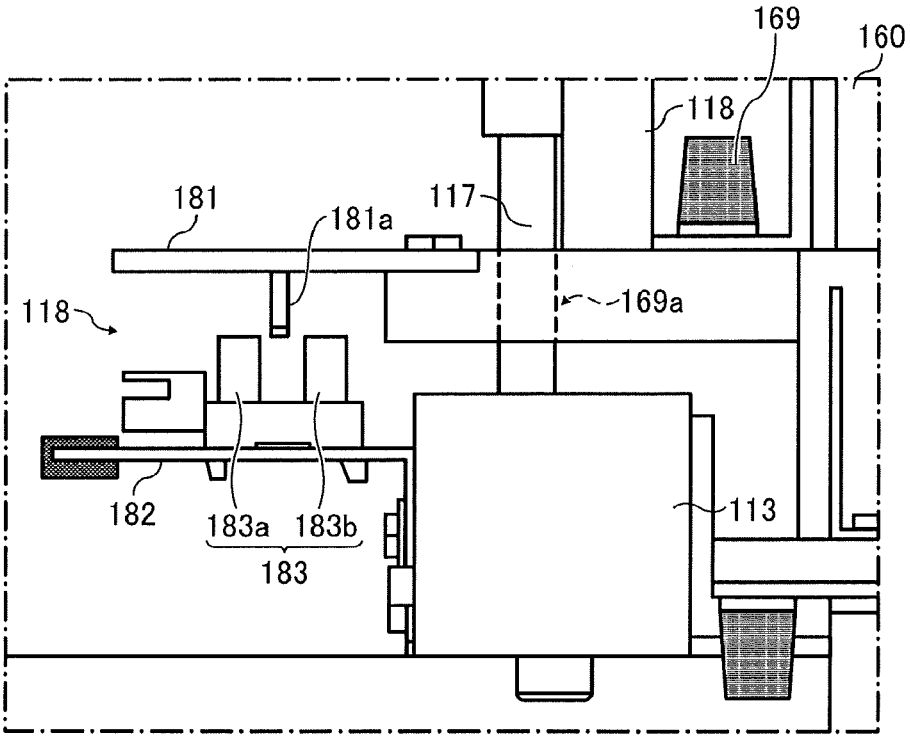
FIG. 16B is an illustration illustrating the elevation detector when the floating-and-retaining conveyance device elevates, according to an embodiment of the present disclosure.

FIG. 16A is an illustration illustrating a configuration example of the elevation detector 180 of the floating-and-retaining conveyance device 160 according to the present embodiment. FIG. 16B is an illustration illustrating the elevation detector 180 when the floating-and-retaining conveyance device 160 elevates. The elevation detector 180 includes a plate-shaped detection target 181 attached to the flange 169 of the floating-and-retaining conveyance device 160, and a transmissive optical sensor 183 secured on a support tool 182 attached to the support frame 113. The optical sensor 183 is formed in such a manner that a light emitter 183*a* and a light receiver 183*b* oppose each other via a predetermined clearance gap. A plate-shaped detection target portion 181*a* of the detection target 181 on the floating-and-retaining conveyance device 160 side that projects downward is formed to be movable into and out of the clearance gap of the optical sensor 183. When the floating-and-retaining conveyance device 160 is at a predetermined retaining conveyance position where the floating-and-retaining conveyance device 160 retains and conveys sheet materials, as illustrated in FIG. 16A, the detection target portion 181*a* is inserted into the clearance gap of the optical sensor 183 to block light, so that light from the light emitter 183*a* is not detected by the light receiver 183*b*. Based on this, it can be recognized that the floating-and-retaining conveyance device 160 has not elevated. On the other hand, when the floating-and-retaining conveyance device 160 elevates by receiving force from the side of elevating sheet materials, as illustrated in FIG. 16B, the detection target portion 181*a* moves out of the clearance gap of the optical sensor 183, so that light from the light emitter 183*a* is detected by the light receiver 183*b*. Based on this, the elevation of the floating-and-retaining conveyance device 160 can be detected.

Figure 17:
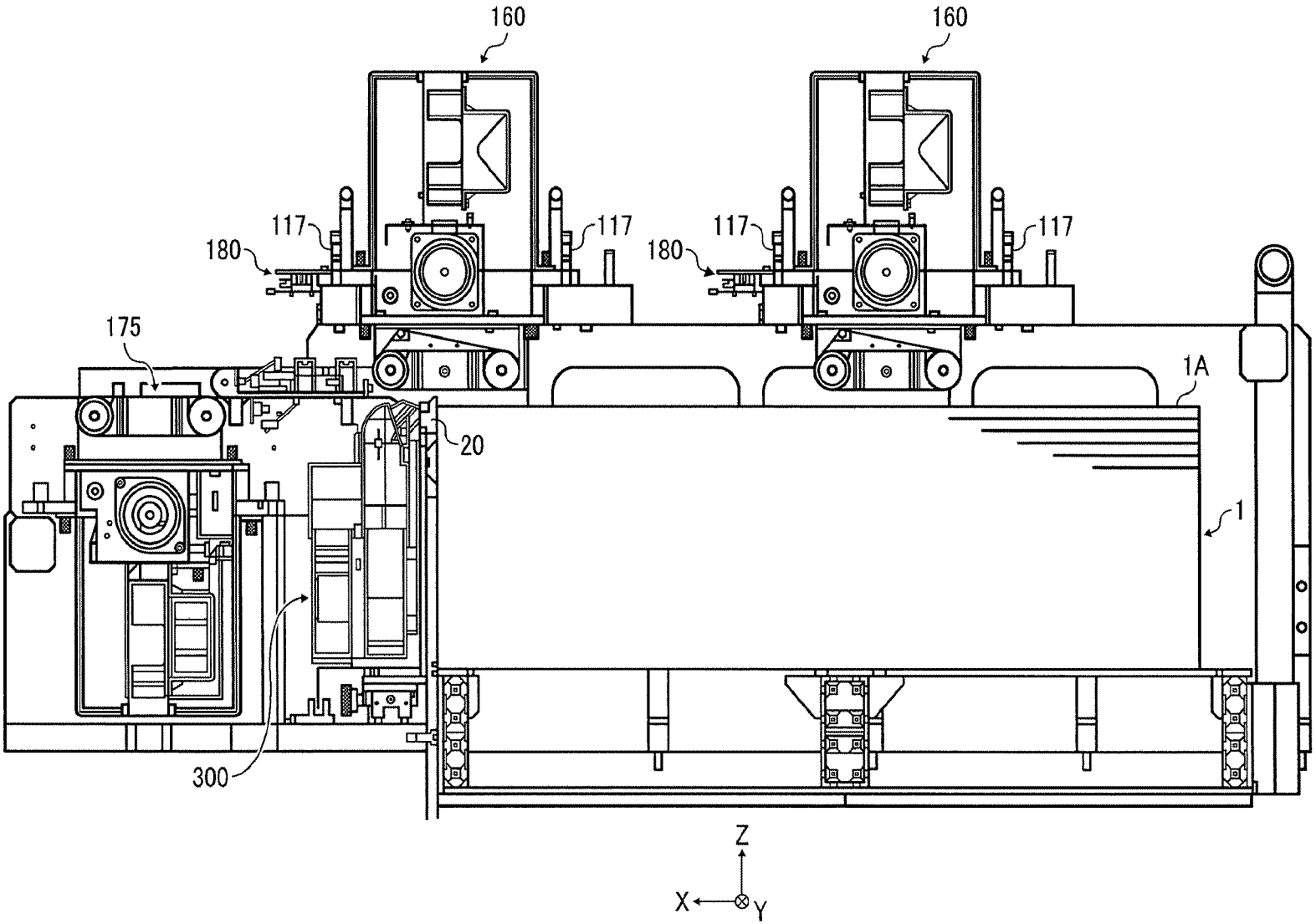
FIG. 17 is an illustration illustrating a relationship between a floating-and-retaining conveyance device and a sheet-material bundle in a normal state of a sheet-material supply device according to an embodiment of the present disclosure.
Figure 18:
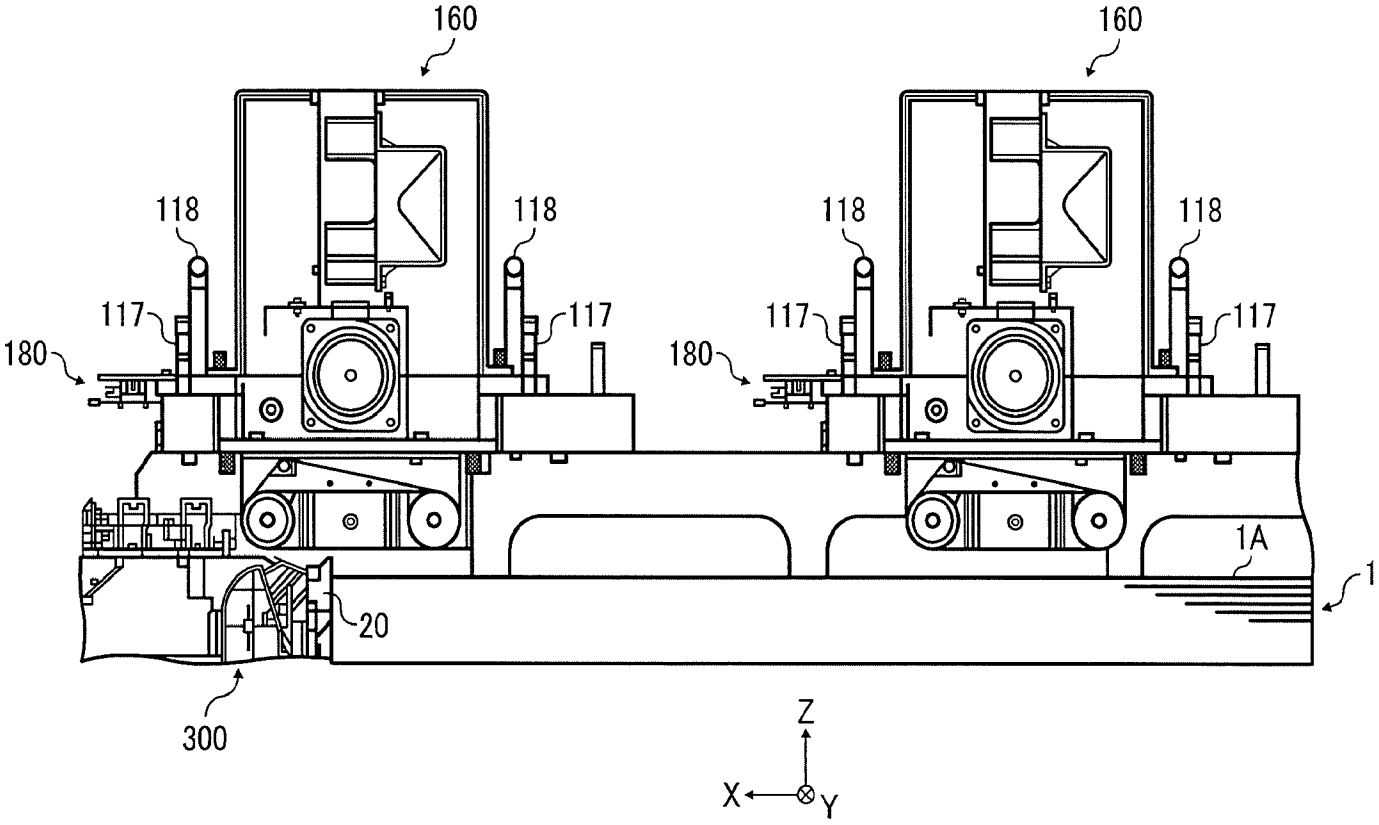
FIG. 18 is a partially enlarged view of the sheet-material supply device illustrated in FIG. 17, according to an embodiment of the present disclosure.

FIG. 17 is an illustration illustrating a relationship between the floating-and-retaining conveyance device 160 and the sheet-material bundle 1 in a normal state of the sheet-material supply device 130 according to the present embodiment, and FIG. 18 is a partially enlarged view thereof. The main body 130' of the sheet-material supply device 130 is provided with a detection sensor 20 that detects that the uppermost sheet material of the sheet-material bundle 1 in the stacked state has reached a predetermined height (position where the sheet material can be retained by the floating-and-retaining conveyance device 160). The detection sensor 20 is formed by, for example, a reflective optical sensor disposed at the predetermined height. In addition, the detection sensor 20 can detect whether the uppermost sheet material of the sheet-material bundle 1 has reached the predetermined height, by detecting light that has been emitted toward an elevation area of the sheet-material bundle 1, and reflected by the sheet materials. In addition, the air ejection nozzle device 300 described in the above comparative example is provided in the vicinity of the detection sensor 20.

In the normal state in which only large-sized (large-format) sheet materials are stacked on the stacking table 136 of the sheet-material supply device 130 illustrated in FIGS. 17 and 18, when the detection sensor 20 detects the sheet-material bundle 1 in the stacked state, the elevation of the stacking table 136 on which the sheet materials are stacked is stopped. At this time, because the floating-and-retaining conveyance device 160 opposes the uppermost sheet material of the sheet-material bundle 1 with a predetermined space with which the sheet material can be sucked and retained, both of the floating-and-retaining conveyance device 160 and the sheet-material bundle 1 are not damaged.

Figure 19:
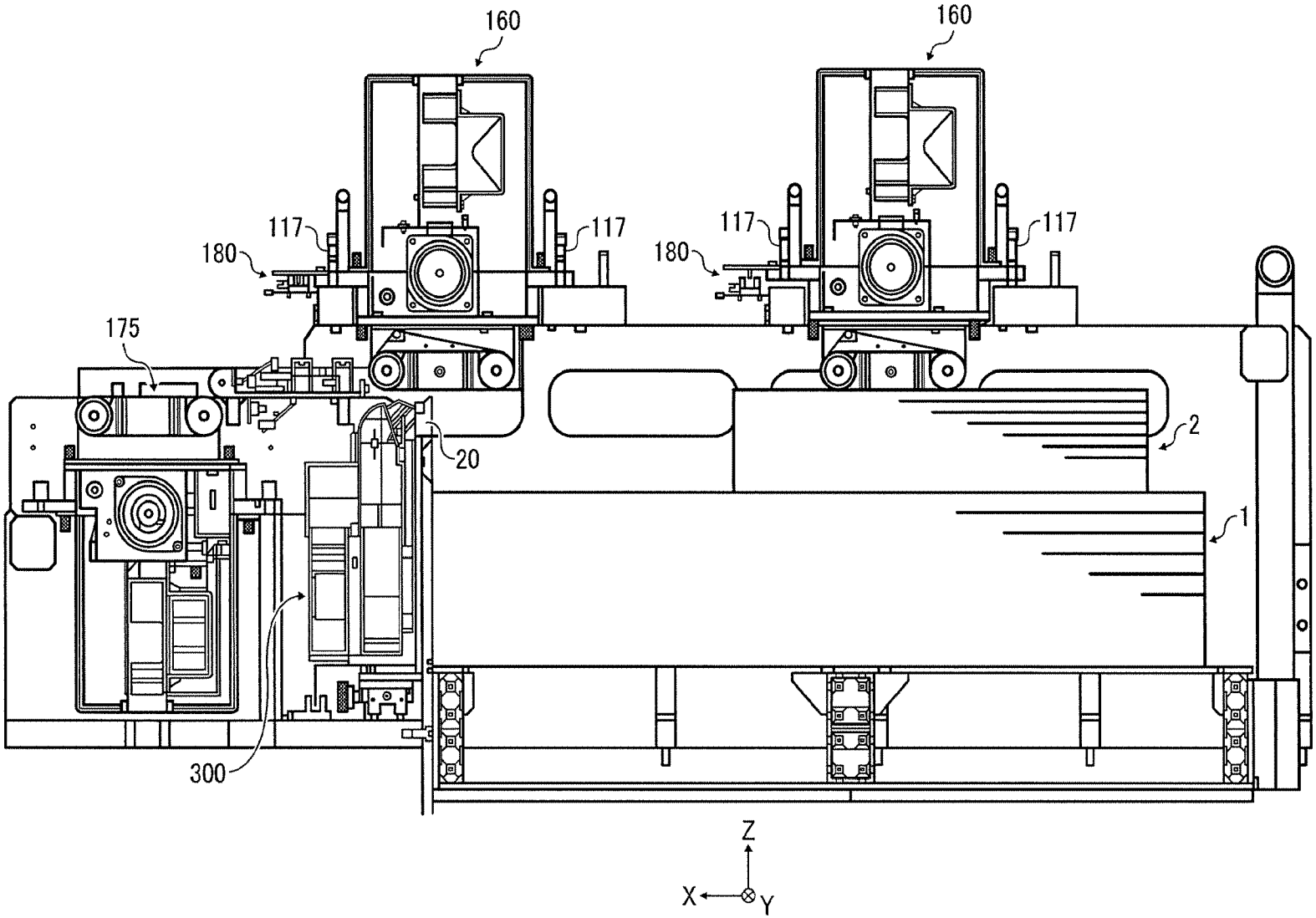
FIG. 19 is an illustration illustrating a relationship between a floating-and-retaining conveyance device and a sheet-material bundle in an abnormal state of a sheet-material supply device according to an embodiment of the present disclosure.
Figure 20:
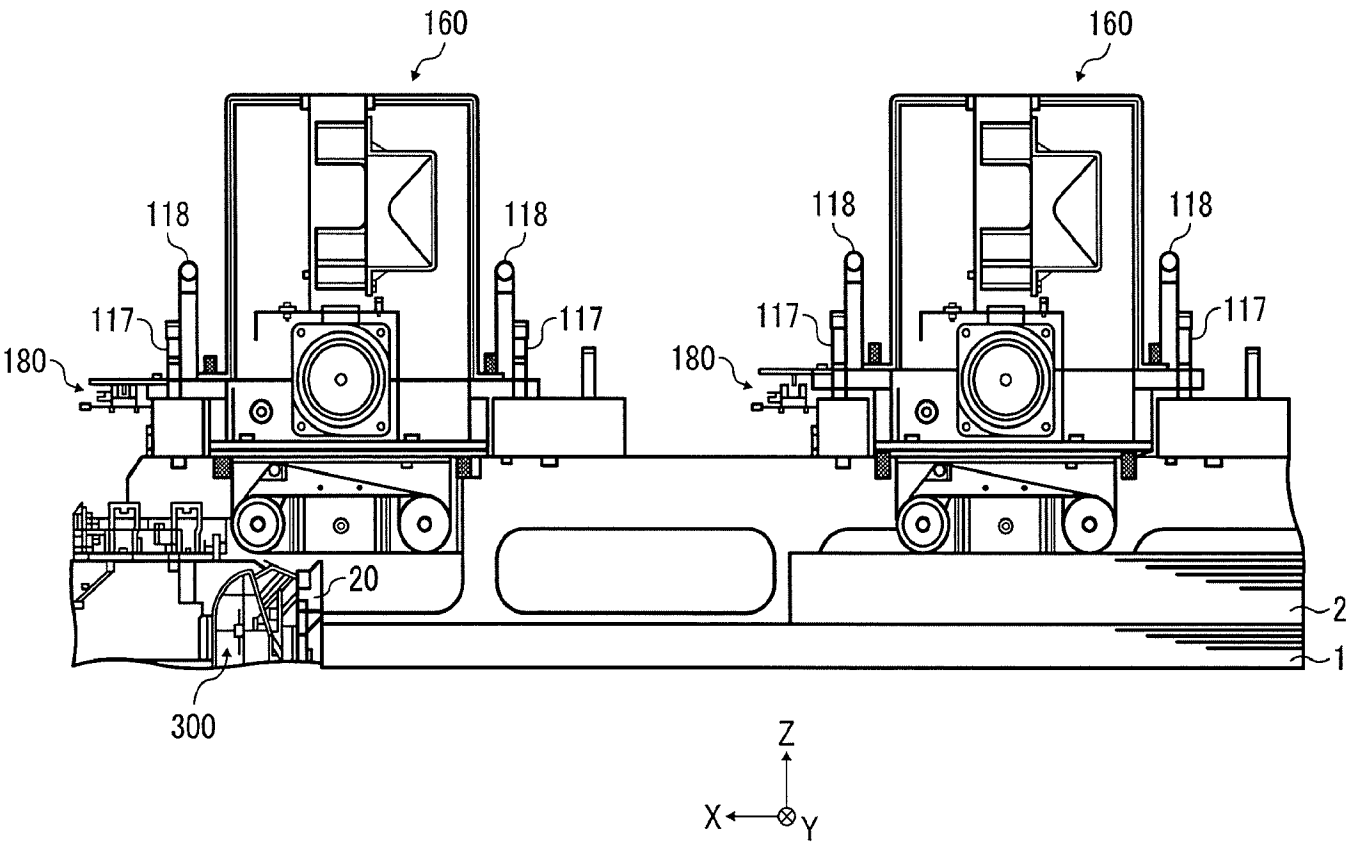
FIG. 20 is a partially enlarged view of the sheet-material supply device illustrated in FIG. 19, according to an embodiment of the present disclosure.

FIG. 19 is an illustration illustrating a relationship between the floating-and-retaining conveyance device 160 and the sheet-material bundle 1 in an abnormal state of the sheet-material supply device 130 according to the present embodiment, and FIG. 20 is a partially enlarged view thereof. In addition, in FIGS. 19 and 20, the parts of the same components as those in FIGS. 17 and 18 are assigned the same signs, and the descriptions thereof will be omitted.

In the abnormal state of the sheet-material supply device 130 illustrated in FIGS. 19 and 20, large-sized (large-format) sheet materials are stacked on the stacking table 136 of the sheet-material supply device 130, and furthermore, a small-sized sheet-material bundle 2 is placed thereon. In this case, before the detection sensor 20 detects the sheet-material bundle 1 in the stacked state, the uppermost face of the small-sized sheet-material bundle 2 contacts a lower end of the floating-and-retaining conveyance device 160, so that the stacking table 136 continues elevating. By the elevation of the stacking table 136, the floating-and-retaining conveyance device 160 receives upward force from the small-sized sheet-material bundle 2, and elevates together. Thus, unlike the case in which the floating-and-retaining conveyance device 160 is fixedly disposed, both of the floating-and-retaining conveyance device 160 and the sheet-material bundle 1 are not damaged.

In addition, in the sheet-material supply device 130 according to the present embodiment, the elevation of the stacking table 136 is controlled to stop when the elevation detector 180 detects the elevation of at least one of the plurality of floating-and-retaining conveyance devices 160. This can prevent the damages to the floating-and-retaining conveyance device 160 and the sheet-material bundle 1 more reliably. In addition, because each of the plurality of floating-and-retaining conveyance devices 160 is provided with the elevation detector 180, various positions of the small-sized sheet-material bundle 2 on the stacking table 136 can be handled. In other words, even if the small-sized sheet-material bundle 2 positions below any of the plurality of floating-and-retaining conveyance devices 160, the damages to the floating-and-retaining conveyance device 160 and the sheet-material bundle 1 that are caused by the elevation of the sheet-material bundle 2 can be prevented more reliably.

According to the sheet-material supply device 130 according to the present embodiment, sheet materials can be supplied without impairing the quality of the sheet materials. A circuit board manufactured using a damaged sheet material as a circuit board sheet may cause a failure in the property of a resistance value or the like. Nevertheless, according to the sheet-material supply device 130 according to the present embodiment, there can be provided a sheet-material supply device that can supply sheet materials without impairing the quality of the sheet materials (without damaging the sheet materials). Thus, the failure of the above-described circuit board can be prevented. This effect is for solving a technical issue specific to circuit board sheets among sheet materials.

In addition, in FIGS. 19 and 20, the description has been given of a case in which the small-sized sheet-material bundle 2 is placed on the large-sized sheet-material bundle 1 in the stacked state. Nevertheless, in a case in which a foreign substance other than the small-sized sheet-material bundle 2 is placed, the damages to the floating-and-retaining conveyance device 160 and the foreign substance can also be prevented.

Figure 21:
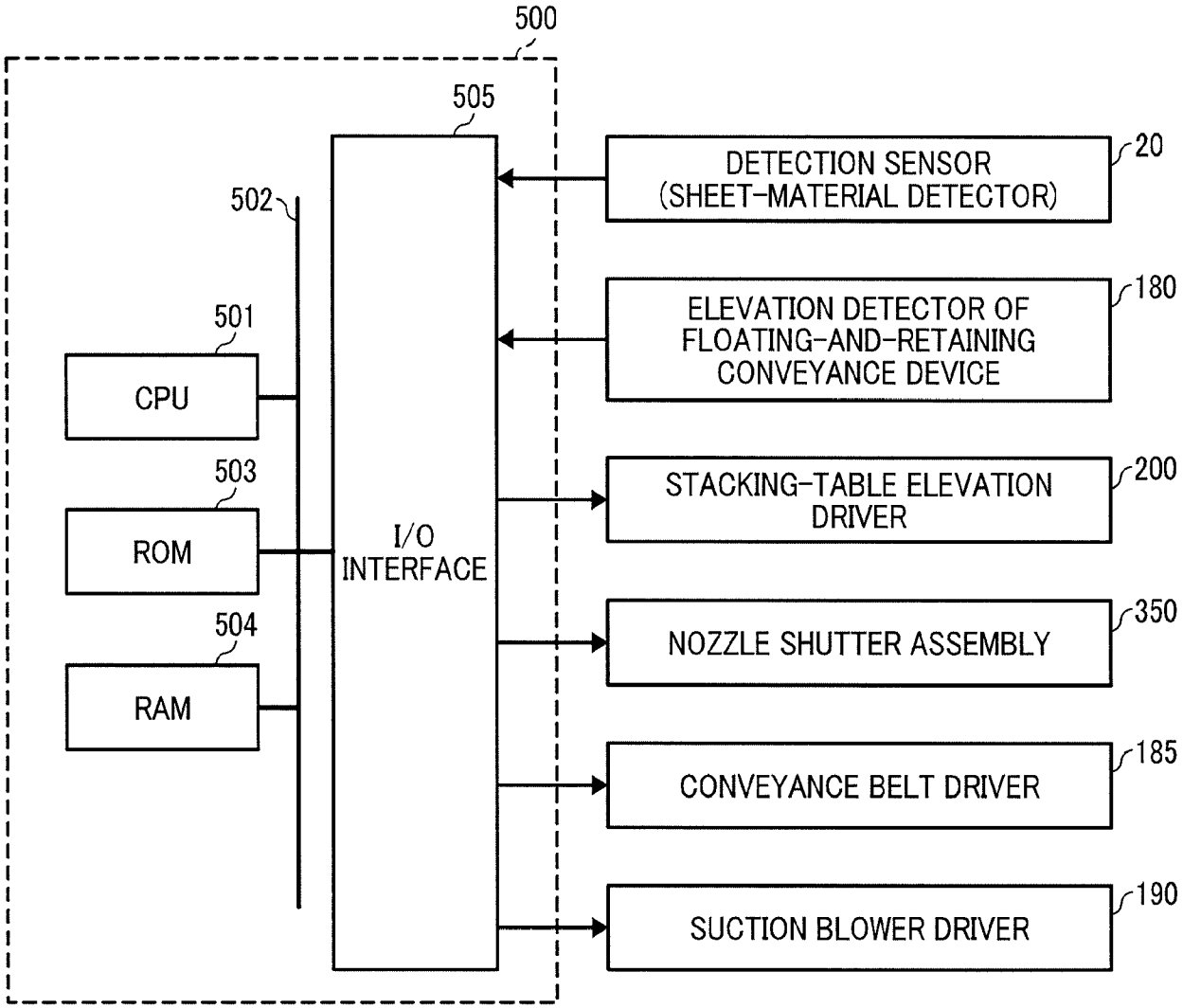
FIG. 21 is a block diagram illustrating an example of a configuration of a part of a control system of a sheet-material supply device according to an embodiment of the present disclosure.

FIG. 21 is a block diagram illustrating an example of a configuration of a part of a control system of the sheet-material supply device 130 according to the present embodiment. The sheet-material supply device 130 includes a control unit 500 formed by, for example, a computer device such as a microcomputer. The control unit 500 functions as a controller that controls the elevation of the sheet-material bundle 1 in the stacked state to stop when the detection sensor 20 detects that the uppermost sheet material of the sheet-material bundle 1 in the stacked state has reached the predetermined height. In addition, the control unit 500 also functions as a controller that controls the elevation of the sheet-material bundle 1 in the stacked state to stop when the elevation detector 180 detects the elevation of the floating-and-retaining conveyance device 160.

The control unit 500 includes a central processing unit (CPU) 501. In addition, the control unit 500 includes a read only memory (ROM) 503 and a random access memory (RAM) 504 that serve as a storage device and are connected to the CPU 501 via a bus line 502, and an input/output (I/O) interface 505. The CPU 501 executes various types of calculation and drive control of each unit by executing control programs being preinstalled computer programs. The ROM 503 prestores computer programs and fixed data such as control data. The RAM 504 functions as a work area or the like that stores various types of data in a rewritable manner. In addition, the control unit 500 may be formed by using, for example, an integrated circuit (IC) or the like that serves as a semiconductor circuit element manufactured for the control in the sheet-material supply device 130, instead of a computer device such as a microcomputer.

Various types of sensors including the detection sensor 20 such as a reflective optical sensor and the elevation detector 180 of the floating-and-retaining conveyance device 160 are connected to the control unit 500 via the I/O interface 505. Here, various types of sensors including the detection sensor 20 and the elevation detector 180 transmit information detected by the sensors to the control unit 500. In addition, a stacking-table elevation driver 200, the above-described nozzle shutter assembly (solenoid) 350, a conveyance belt driver 185, a suction blower driver 190, and the like are connected to the control unit 500 via the I/O interface 505. The control unit 500 controls each unit at a predetermined timing.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The effect described in the embodiments of the present disclosure is an example of effects. The effect of the embodiments is not limited to the above-described example.

The above-described embodiments and examples are limited examples, and the present disclosure includes, for example, the following aspects having advantages.

Aspect A

A sheet-material supply device, such as the sheet supply device 130, includes a lift, such as a lift device 120, to elevate sheet materials in a stacked state; a sheet-material detector, such as the conveyed-material sensor 20, to detect that an uppermost sheet material of the sheet materials in the stacked state has reached a predetermined height; and a sheet-material retaining conveyor, such as the floating-and-retaining conveyance device 160, to retain and convey the uppermost sheet material that has reached the predetermined height. The sheet-material supply device stops elevation of the sheet materials in the stacked state when the sheet-material detector detects that the uppermost sheet material has reached the predetermined height. The sheet-material retaining conveyor is disposed to be movable in a direction in which the sheet materials in the stacked state elevate. As described in the above-described embodiments, for such a configuration, sheet materials in a stacked state may be elevated upward in a state in which a small-seized sheet material or foreign substance is placed on the uppermost face of the sheet materials in the stacked state. In the elevation of the sheet materials in the stacked state, even if the small-seized sheet material or foreign substance contacts sheet-material retaining conveyor before detection of the sheet materials to stop the elevation, the sheet-material retaining conveyor elevates together the small-seized sheet material or foreign substance in contact with the sheet-material retaining conveyor. As described above, the elevation of the sheet-material retaining conveyor together the small-seized sheet material or foreign substance prevents a strong force from the small-seized sheet material or foreign substance from acting on the sheet-material retaining conveyor. Such a configuration can prevent damage to the sheet-material retaining conveyor in the elevation of the small-seized sheet material or foreign substance.

Aspect B

The sheet-material supply device according to aspect A further includes an elevation detector, such as the elevation detector 180, to detect elevation of the sheet-material retaining conveyor from a retaining position at which the sheet-material retaining conveyor retains the uppermost sheet material that has reached the predetermined height; and a controller, such as the controller 500, to control elevation of the sheet materials in the stacked state to stop when the elevation detector detects elevation of the sheet-material retaining conveyor. According to aspect B, as described in the above-described embodiments, elevation of the sheet materials in the stacked state is stopped when elevation of sheet-material retaining conveyor is detected, thus more reliably preventing damage to the sheet-material retaining conveyor.

Aspect C

The sheet-material supply device according to aspect B, the sheet-material supply device includes a plurality of sheet-material retaining conveyors, such as the floating-and-retaining conveyance devices 160, to retain a plurality of portions of the uppermost sheet material different from each other in a plane direction of the uppermost sheet material; and a plurality of elevation detectors, such as the elevation detectors 180, to detect elevation of the plurality of sheet-material retaining conveyors. The controller controls elevation of the sheet materials in the stacked state to stop when at least one of the plurality of elevation detectors detects elevation of at least one of the plurality of sheet-material retaining conveyors. As described in the above-described embodiments, such a configuration can stably and reliably retain large-sized sheet materials with the plurality of sheet-material retaining conveyors. In addition, when the elevation of at least one of the sheet-material retaining conveyor is detected, the elevation of the sheet materials in the stacked state is stopped, thus reliably preventing damage to the plurality of sheet-material retaining conveyors.

Aspect D

The sheet-material supply device according to aspect B or C, the sheet-material retaining conveyor(s) is (are) attachable to and detachable from a device body, such as the device body 130', of the sheet-material supply device. The elevation detector(s), such as the elevation detector(s) 180, is (are) also an attachment and detachment detector(s) to detect attachment and detachment of the sheet-material retaining conveyor(s). As described in the above-described embodiments, such a configuration obviates the necessity of additional attachment and detachment detector(s), thus allowing cost reduction and downsizing of the sheet supply device.

Aspect E

The sheet-material supply device according to any one of aspects A to D further includes a sheet-material floating unit, such as the air jetting nozzle device 300, to float a sheet material near a top of the sheet materials in the stacked state. As described in the above-described embodiments, such a configuration can more reliably separate and retain the uppermost sheet of the sheet materials in the stacked state.

What is claimed is:

1. A sheet-material supply device comprising:

a lift to elevate sheet materials in a stacked state;

a sheet-material detector to detect that an uppermost sheet material of the sheet materials in the stacked state has reached a predetermined height;

a plurality of sheet-material retaining conveyors to retain and convey a plurality of portions of the uppermost sheet material that are different from each other in a plane direction of the uppermost sheet material and have reached the predetermined height; and a plurality of elevation detectors to detect elevation of the sheet-material retaining conveyors from a retaining position at which the sheet-material retaining conveyors retain the uppermost sheet material that has reached the predetermined height, an orientation of the sheet-material retaining conveyors being maintained during the elevation, wherein the sheet-material supply device stops elevation of the sheet materials in the stacked state when the sheet-material detector detects that the uppermost sheet material has reached the predetermined height, wherein the sheet-material retaining conveyors are disposed to be movable while maintaining its orientation in a direction in which the sheet materials in the stacked state elevate, wherein each of the sheet-material retaining conveyors is attachable to and detachable from a device body of the sheet-material supply device, and wherein each of the elevation detectors is also an attachment and detachment detector to detect attachment and detachment of the respective sheet-material retaining conveyor.

2. The sheet-material supply device according to claim 1, further comprising:

a controller to control elevation of the sheet materials in the stacked state to stop when the elevation detector detects elevation of the sheet-material retaining conveyors.

3. The sheet-material supply device according to claim 2, wherein the controller controls elevation of the sheet materials in the stacked state to stop when at least one of the plurality of elevation detectors detects elevation of at least one of the plurality of sheet-material retaining conveyors.

4. The sheet-material supply device according to claim 1, further comprising a sheet-material floating unit to float a sheet material near a top of the sheet materials in the stacked state.

5. The sheet-material supply device according to claim 1, wherein each of the elevation detectors includes an optical sensor detecting the elevation of the respective sheet-material retaining conveyor.

6. The sheet-material supply device according to claim 5, wherein the optical sensor is in a first state when the respective sheet-material retaining conveyor is elevated and is in a second state when the respective sheet-material retaining conveyor is not elevated.

7. The sheet-material supply device according to claim 6, wherein the optical sensor includes a light emitter and a light receiver defining a clearance gap, and the respective elevation detector includes a movable detection target that interferes with the clearance gap.

8. A sheet-material supply device comprising:

a lift to elevate sheet materials in a stacked state;

a sheet-material detector to detect that an uppermost sheet material of the sheet materials in the stacked state has reached a predetermined height;

a sheet-material retaining conveyor to retain and convey the uppermost sheet material that has reached the predetermined height; and an elevation detector to detect elevation of the sheet-material retaining conveyor from a retaining position at which the sheet-material retaining conveyor retains the uppermost sheet material that has reached the predetermined height, an orientation of the sheet-material retaining conveyor being maintained during the elevation, wherein the sheet-material supply device stops elevation of the sheet materials in the stacked state when the sheet-material detector detects that the uppermost sheet material has reached the predetermined height, wherein the sheet-material retaining conveyor is disposed to be movable in a direction in which the sheet materials in the stacked state elevate, wherein the sheet-material retaining conveyor is attachable to and detachable from a device body of the sheet-material supply device, and wherein the elevation detector is also an attachment and detachment detector to detect attachment and detachment of the sheet-material retaining conveyor.

9. The sheet-material supply device according to claim 8, wherein the elevation detector includes an optical sensor detecting the elevation of the sheet-material retaining conveyor.

10. The sheet-material supply device according to claim 9, wherein the optical sensor is in a first state when the sheet-material retaining conveyor is elevated and is in a second state when the sheet-material retaining conveyor is not elevated.

11. The sheet-material supply device according to claim 10, wherein the optical sensor includes a light emitter and a light receiver defining a clearance gap, and the elevation detector includes a movable detection target that interferes with the clearance gap.

* * * * *